US011383210B2

(12) United States Patent
Hwang et al.

(10) Patent No.: US 11,383,210 B2
(45) Date of Patent: Jul. 12, 2022

(54) WASHING MACHINE AND MICRO-BUBBLE GENERATOR THEREOF

(71) Applicant: Daewoo Electronics Corporation, Gwangju (KR)

(72) Inventors: Ui Kun Hwang, Incheon (KR); Man Ki Kim, Incheon (KR); Jae Woo Lee, Incheon (KR)

(73) Assignee: Daewoo Electronics Corporation, Gwangju (KR)

( * ) Notice: Subject to any disclaimer, the term of this patent is extended or adjusted under 35 U.S.C. 154(b) by 427 days.

(21) Appl. No.: 16/366,784

(22) Filed: Mar. 27, 2019

(65) Prior Publication Data

US 2019/0301069 A1 Oct. 3, 2019

(51) Int. Cl.

| | |
|---|---|
| ***D06F 35/00*** | (2006.01) |
| ***B01F 23/232*** | (2022.01) |
| ***D06F 23/04*** | (2006.01) |
| *D06F 39/08* | (2006.01) |
| *B01F 23/2373* | (2022.01) |
| *B01F 101/00* | (2022.01) |

(52) U.S. Cl.

CPC ..... *B01F 23/2323* (2022.01); *D06F 23/04* (2013.01); *D06F 35/002* (2013.01); *B01F 23/2373* (2022.01); *B01F 2101/4505* (2022.01); *D06F 39/088* (2013.01)

(58) Field of Classification Search

CPC ..... D06F 33/42; D06F 33/47; D06F 33/62; D06F 33/74; D06F 34/00–34; D06F 35/002; D06F 37/42; D06F 39/08; D06F 39/088; D06F 2101/00–20; D06F 2103/00–70; D06F 2105/50–62

See application file for complete search history.

(56) References Cited

U.S. PATENT DOCUMENTS

| | | | | |
|---|---|---|---|---|
| 2008/0034813 | A1* | 2/2008 | Tobias | D06F 87/00 68/222 |
| 2018/0274154 | A1* | 9/2018 | Park | D06F 39/028 |
| 2018/0274164 | A1* | 9/2018 | Kim | D06F 39/085 |
| 2018/0298541 | A1* | 10/2018 | Sasaki | D06F 39/08 |

FOREIGN PATENT DOCUMENTS

| | | | | |
|---|---|---|---|---|
| WO | WO-2017110406 A1 * | 6/2017 | | D06F 33/00 |

* cited by examiner

*Primary Examiner* — David G Cormier

(74) *Attorney, Agent, or Firm* — Andrew D. Fortney; Central California IP Group, P.C.

(57) ABSTRACT

A washing machine that includes a cabinet; an outer basket in the cabinet and configured to accommodate wash water; an inner basket in the outer basket and configured to accommodate laundry; a water supply valve unit in the cabinet and connected to an external water supply source, configured to receive wash water; and a micro-bubble generator configured to receive the wash water from the water supply valve unit, generate micro-bubbles, and supply the micro-bubbles to a washing space. The micro-bubble generator includes a dissolving unit configured to mix or dissolve gas into the wash water from the water supply valve unit. The dissolving unit includes: a water supply line connection connected indirectly to the water supply valve unit, configured to introduce the wash water; a supply hole providing a path in which gas is introduced into a dissolution space; and a dissolved water drain portion discharging the wash water in which gas is mixed or dissolved.

10 Claims, 18 Drawing Sheets

(a)

(b)

WASHING MACHINE AND MICRO-BUBBLE GENERATOR THEREOF

TECHNICAL FIELD

The disclosure relates to a washing machine and a micro-bubble generator for the same.

BACKGROUND

A washing machine is a device for separating contaminants from laundry using wash water and detergent, and may separate contaminants from the laundry by chemical action using a detergent dissolved in the wash water and mechanical action of the wash water and an inner basket.

The detergent is usually put in with wash water and dissolved in the wash water during the washing process to remove the contaminants from the laundry by the chemical action. However, depending on the temperature and amount of the wash water, the amount of the introduced detergent, etc., the detergent may not dissolve in the wash water and may remain in the laundry. When the detergent is not sufficiently dissolved, cleaning action may not be sufficient, and accordingly, contaminants may remain in the laundry. Detergent or foreign matter remaining in the laundry may reduce the user's satisfaction and may cause skin troubles.

Various techniques have been proposed to eliminate the detergent or foreign matter remaining in laundry. For example, a micro-bubble method has been proposed. A micro-bubble refers to a small bubble having a diameter of a few micrometers to a few nanometers, and can be characterized as being invisible in water. Specifically, micro-bubbles may be generally understood as a concept collectively encompassing micro-bubbles having a diameter of 50 μm or less, micro/nano-bubbles (having diameters of 10 nm or more and less than 1 μm), and nano-bubbles (having diameters of less than 10 nm). Micro-bubbles have high internal pressures, so that if the micro-bubbles burst in the water, they may impact any nearby laundry, thereby effectively separating the detergent or foreign matter from the nearby laundry.

In order to generate the micro-bubbles, a micro-bubble generator is provided in the washing machine. Micro-bubble generators include a separate power device such as a compressor and a pump that may be directly used to generate the bubbles, and a flow characteristic that may be used without the separate power device.

However, since power-based micro-bubble generators may use a high-performance power device to generate the micro-bubbles, there are disadvantages in that the structure is complicated, the maintenance cost is high, the noise and vibration are serious, and the production unit cost is high. In contrast, mechanical micro-bubble generators (without the power device) have advantages in that the structure may be simple, the maintenance cost may be low, the noise and vibration may be relatively weak, and the manufacturing cost may be low.

However, in the case of a micro-bubble generator which does not use a power device, micro-bubbles generated in or through a flow path having a predetermined shape are discharged primarily to the outside of the micro-bubble generator, so that there is a disadvantage that is difficult to generate sufficient micro-bubbles.

In addition, in the prior art, after the micro-bubbles are generated, the wash water containing micro-bubbles is transferred to a predetermined discharging position using a hose. During the movement along the hose, the micro-bubbles disappear, so that there is a disadvantage in that the amount of micro-bubbles introduced into the inner basket (that substantially performs washing) is small.

SUMMARY

Various embodiments of the disclosure have been proposed in order to solve the above problems and provide a washing machine and a micro-bubble generator for the washing machine that can increase the amount of microbubbles and improve the washing power and the rinsing power of the washing machine.

Further, embodiments of the disclosure provide a washing machine and a micro-bubble generator for the washing machine that supply generated micro-bubbles to inside of the inner basket in which washing is performed without being extinguished.

In accordance with an aspect of the present invention, there is provided a washing machine, comprising: a cabinet; an outer basket in the cabinet and configured to accommodate wash water an inner basket in the outer basket and configured to accommodate laundry; a water supply valve unit in the cabinet and connected to an external water supply source to receive wash water; and a micro-bubble generator configured to receive the wash water from the water supply valve unit, generate micro-bubbles, and supply the micro-bubbles to a washing space (e.g., in the washing machine), wherein the micro-bubble generator includes a dissolving unit configured to mix or dissolve gas into the wash water from the water supply valve unit, and wherein the dissolving unit includes a water supply line connection connected indirectly to the water supply valve unit to introduce the wash water (e.g., to the dissolving unit); a supply hole providing a path in which gas is introduced into a dissolution space in the dissolving unit; and a dissolved water drain portion discharging the wash water in which gas is dissolved or mixed.

A partition wall may be in the dissolving unit, and the partition wall may partition the dissolution space into an inner dissolution space and an outer dissolution space.

The partition wall may extend a set distance upward from an inner bottom surface of the dissolving unit.

The partition wall may include a residual water discharge hole to drain the wash water remaining inside (e.g., the dissolving unit).

The dissolved water drain portion may be on or in an outer circumferential surface of the dissolving unit, and the residual water discharge hole may be oriented in a direction opposite to a direction in which the dissolved water drain portion is oriented.

The inner bottom surface of the dissolving unit inside the partition wall may be angled or inclined toward the residual water discharge hole.

The bottom surface inside the dissolving unit, but outside the partition wall, may be angled or inclined in a direction toward the dissolved water drain portion from the residual water discharge hole.

The micro-bubble generator may further include a nozzle unit attached to the dissolving unit configured to form micro-bubbles in the wash water from the dissolved water drain portion and discharge the same.

The nozzle unit may include a micro-bubble generator in the dissolved water drain portion and having a decomposition unit including a path through which the wash water flows; and a nozzle portion coupled to the dissolving unit so that the micro-bubble generator is fixed in the dissolved water drain portion, the nozzle portion being configured to discharge the wash water.

The decomposition unit may comprise a cone (e.g., a tube having a larger diameter along the direction of the wash water flow from the dissolving unit).

The nozzle unit may further include a gasket in the nozzle unit at an end of the micro-bubble generator and against an end of the dissolved water drain portion.

The dissolving unit may be above the inner basket.

The washing machine may further comprise a control unit configured to control components of the washing machine, including the water supply valve unit to supply the wash water to a flow path passing through the dissolving unit until a set time has elapsed, and when a set amount of the wash water has not been supplied at the set time, to supply the wash water with the wash water in a flow path not passing through the dissolving unit.

In accordance with another aspect of the present invention, there is provided a micro-bubble generator to be installed in a washing machine, configured to receive wash water, generate micro-bubbles and supply the wash water containing the micro-bubbles to an inner basket of the washing machine (e.g., where laundry is received). The micro-bubble generator includes a dissolving unit, and the dissolving unit includes a dissolving body having a cylindrical or tubular shape, an open upper end and a dissolved water drain portion at one side, configured to discharge wash water having mixed or dissolved gas therein; and a cap fastened to the open upper end of the dissolving body having a water supply line connection unit configured to receive the wash water, and a supply hole configured to introduce gas into a dissolution space in the dissolving body.

A partition wall in the dissolving unit may extend a set distance upward from an inner bottom surface of the dissolving unit.

The partition wall may include a residual water discharge hole oriented in a direction opposite to a direction in which the dissolved water drain portion is oriented.

The micro-bubble generator may further include a nozzle unit attached to the dissolving unit, configured to form micro-bubbles in the wash water from the dissolved water drain portion and discharge the same, and the nozzle unit may include a micro-bubble generator in the dissolved water drain portion and having a decomposition unit including a path through which wash water flows; and a nozzle portion coupled to the dissolving unit so that the micro-bubble generator is fixed in the dissolved water drain portion and configured to discharge wash water.

In accordance with yet another aspect of the present invention, there is provided a washing machine, comprising a cabinet; an outer basket in the cabinet and configured to accommodate wash water an inner basket in the outer basket and configured to accommodate laundry; a water supply valve unit in the cabinet and connected to an external water supply source to receive wash water; a micro-bubble generator configured to receive wash water from the water supply valve unit, generate micro-bubbles, and supply the micro-bubbles to a washing space (e.g., in the washing machine); and a control unit configured to control components of the washing machine, including the water supply valve unit to supply the wash water to a flow path passing through the dissolving unit until a set time has elapsed, and when a set amount of the wash water has not been supplied at the set time, to supply the wash water with the wash water in a flow path not passing through the dissolving unit.

The dissolving unit may include a water supply line connection unit connected indirectly to the water supply valve unit to introduce the wash water (e.g., to the dissolving unit); a supply hole providing a path in which gas is introduced into a dissolution space in the dissolving unit; and a dissolved water drain portion discharging wash water in which gas is dissolved or mixed.

A partition wall may be in the dissolving unit, may extend a set distance upward from an inner bottom surface of the dissolving unit, and may partition the dissolution space into an inner dissolution space and an outer dissolution space. The partition wall may include a residual water discharge hole configured to drain the wash water remaining inside the dissolving unit.

In a washing machine and a micro-bubble generator of a washing machine according to the embodiments of the disclosure, there is an advantage in that it is possible to increase the amount of micro-bubbles to be produced to improve the washing power and the rinsing power.

Further, there is an effect in that the generated micro-bubbles can be supplied to the inside of the inner basket where the washing is performed without being extinguished.

DETAILED DESCRIPTION

A washing machine is for washing laundry, and various types of washing machines are known, including a top loading type washing machine, a front-loading type drum washing machine, and a hybrid type washing machine combining the top loading type and the front-loading type. Typically, such washing machines include an inner basket where laundry is received, an outer basket where the wash water is accommodated, a motor that drives the inner basket, and the like.

In one embodiment, the top loading type washing machine is described as an example, but an idea of the disclosure may be applicable to other types of washing machines.

Figure 1:
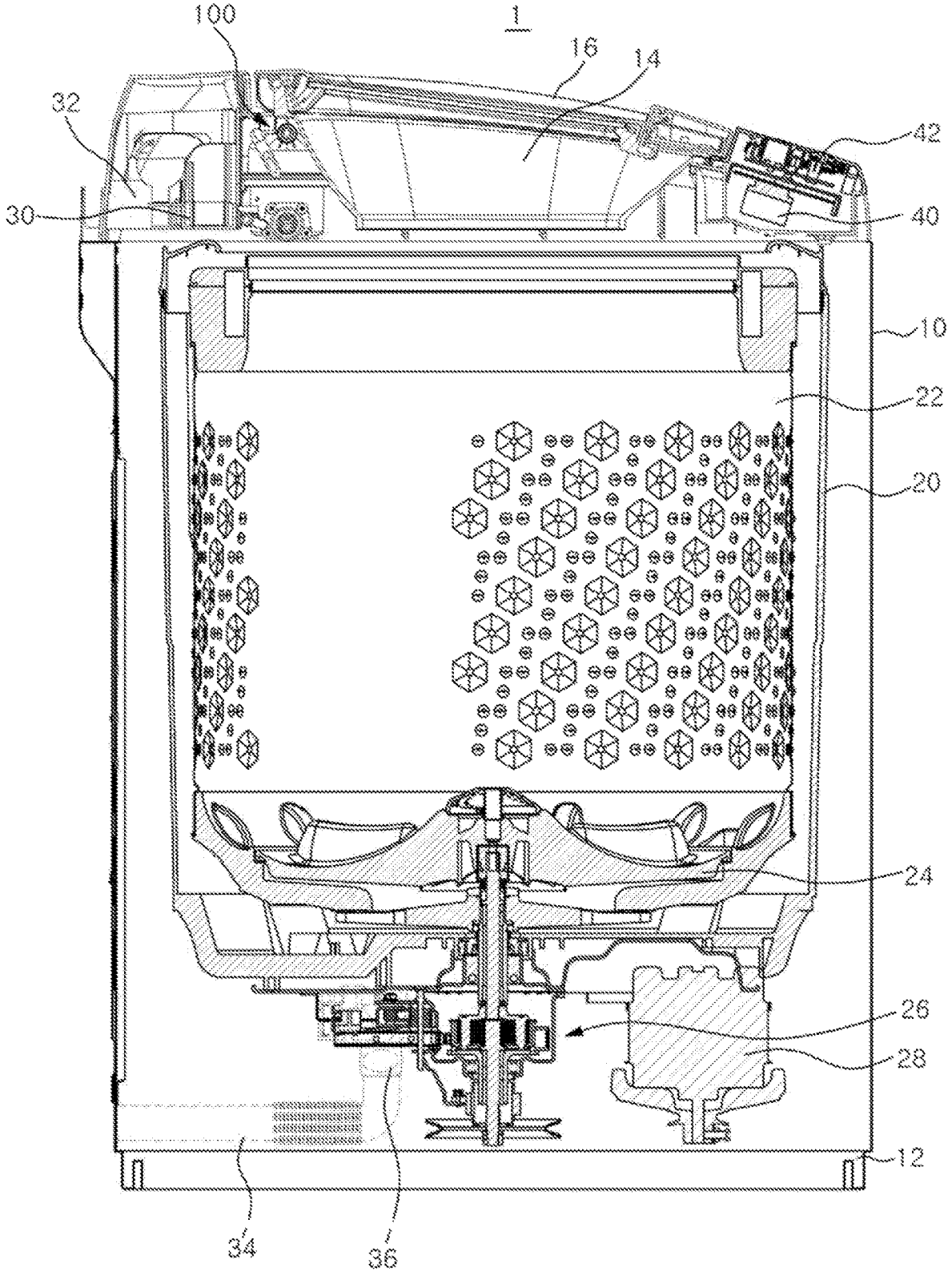
FIG. 1 is a schematic view showing a schematic configuration of an exemplary washing machine according to an embodiment of the disclosure.

FIG. 1 is a schematic view showing a washing machine according to an embodiment of the disclosure.

Referring to FIG. 1, a washing machine 1 according to an embodiment of the disclosure includes a cabinet 10 having an outer appearance, a base 12 coupled to a lower portion of the cabinet 10, a cabinet cover 14 coupled to an upper portion of the cabinet 10, and a door 16 which is coupled to the cabinet cover 14 and which may be opened or closed.

Specifically, the cabinet 10 may have upper and lower surfaces and may have or form one or more side surfaces of the washing machine 1. The base 12 supporting the washing machine 1 may be on the lower side of the cabinet 10, and a cabinet cover 14 may be coupled to the upper side of the cabinet 10. The cabinet cover 14 on the upper side of the cabinet 10 may include an input hole for placing laundry into the washing machine 1. In addition, a door 16 is on or above the cabinet cover 14, and the door 16 may close or open the input hole for loading or unloading the laundry. The user may open or close the door 16 to load the laundry in the washing machine 1 when a washing process is to be performed, or unload the laundry when the washing process is completed, and may shield the laundry by covering the input hole with the door 16 when performing the washing process.

In addition, the washing machine 1 may include an outer basket 20, which is housed in the cabinet 10 and which may contain wash water, and an inner basket 22, which is in the outer basket 20 and which receives the laundry. The outer basket 20 and the inner basket 22 are inside the cabinet 10, and the outer basket 20 and the inner basket 22 have a similar shape, wherein the inner basket 22 may have a diameter that is smaller than the diameter of the base 20 by a predetermined length. That is, the inner basket 22 may be spaced apart from the outer basket 20 by a predetermined distance on the inside of the outer basket 20. A plurality of holes for fluid communication with fluid in the outer basket 20 may be in or around the inner basket 22. The outer basket 20 and the inner basket 22 are in fluid communication with each other through the plurality of holes in the inner basket 22, such that the wash water of the inner basket 22 may flow into the outer basket 20. Likewise, the wash water of the outer basket 20 may flow into the inner basket 22. The outer basket 20 and the inner basket 22 may have a cylindrical shape, but are not limited thereto.

The top-loading washing machine 1 as in the present embodiment may further include a pulsator 24. The pulsator 24 may be joined to or integrated with the lower portion of the inner basket 22 to form a bottom surface of the inner basket 22. The pulsator 24 is on the bottom of the inner basket 22 and forms a rotating flow and vortex in the wash water in the laundry space. As used herein, the laundry space is a space inside the outer basket 20, and includes an inner space of the inner basket 22. Accordingly, the laundry space refers to a space where the laundry and the wash water may be accommodated. The pulsator 24 is connected to a gear assembly 26 and may be rotated by a rotational force from the motor 28 through the gear assembly 26. A strong vortex may be formed in the radial direction by the rotational force of the pulsator 24, and the washing process may be performed while the wash water and laundry in the inner basket 22 are rotated by the strong vortex. During the washing process, the wash water between the inner basket 22 and the outer basket 20 may rise upwards due to the strong radial vortex in the inner basket 22. Accordingly, the wash water circulates in the washing space, including the outer basket 20 and the inner basket 22, during the washing time, and the laundry may be washed while the vortex is present. In some cases, as the pulsator 24 rotates, the inner basket 22 may or may not rotate together with the pulsator 24. For example, when the inner basket 22 and the pulsator 24 are integral with each other, the inner basket 22 may rotate together with the pulsator 24 when the pulsator 24 rotates, but when the pulsator 24 and the inner basket 22 are separate and/or fastened to each other, only the pulsator 24 rotates to form the vortex.

Meanwhile, when the washing machine 1 includes a drum 22' (FIG. 13) without the pulsator 24, the gear assembly 26 and the motor 28 may be connected directly to the outer basket 20 or the inner basket 22.

Further, the washing machine 1 may include a detergent container 30, a water supply valve unit 32, a main drain hose 34 and a main drain valve 36.

The detergent container 30 may have a drawer or tray shape that moves in the cabinet cover 14 in a sliding manner. As an example, the cabinet cover 14 may include a detergent container accommodating portion 15 (FIG. 11), and the detergent container 30 may be in the detergent container accommodating portion 15. The detergent container 30 may include a space for the detergent and a space for a fabric softening agent. The detergent container 30 may be opened and closed by sliding it away from and toward the inside of the washing machine 1, respectively, and a water supply valve unit 32 may be connected to an outer surface of the detergent container 30. (Hereinafter, the space within the inner basket 22 where the laundry is received may be referred to as an "inner side," and the surface[s] of the cabinet 10 forming the outer appearance of the washing machine 1 may be referred to as an "outer side".) The wash water may be supplied to the detergent container 30 through the water supply valve unit 32 (which is connected to an external water supply source), then to the inner basket 22 through the detergent container 30. Since the wash water is supplied to the inner basket 22 through the detergent container 30, the wash water supplied to the inner basket 22 may contain a detergent or softening agent mixed or dissolved therein.

The water supply valve unit 32 may be on the cabinet cover 14 and may be connected to an external water supply source via an external hose (not shown) to receive the wash water from the external water supply source. The water supply valve unit 32 may be or comprise a four-way valve (not shown). Although not shown in the drawings, the four-way valve may include a hot water supply valve for supplying hot water, a cold water supply valve for supplying cold water, and a micro-bubble generating water supply valve for supplying cold water to generate micro-bubbles. The hot water supply valve may be in fluid communication with the space for the detergent. In addition, the cold water supply valve may be or comprise a two-way valve, one outlet of which is in fluid communication with the space for the detergent, and the other outlet of which is in fluid communication with the space for the softening agent. The micro-bubble generating water supply valve may be connected to a dissolving unit 100 for producing micro-bubbles.

Meanwhile, according to one or more embodiments, the water supply valve configured to generate the micro-bubbles may be omitted. In this case, a cold water feed valve or hot water feed valve may be connected directly to the dissolving unit 100 to supply the wash water.

The main drain valve 36 may be at a lower portion (e.g., a lowermost surface) of the outer basket 20 and may control discharge of the wash water from the outer basket 20. Specifically, the main drain valve 36 may communicate with the lower portion of the outer basket 20, and the main drain hose 34 may be connected to the main drain valve 36. When the wash water used for washing is discharged to the outside, the main drain valve 36 may be opened to discharge the wash water through the main drain hose 34, and when the wash water is supplied for performing the washing process, the main drain valve 36 may be closed to allow the wash water to be received in the outer basket 20 and the inner basket 22.

In addition, the washing machine 1 may include a control unit 40 and an operation unit 42. The operation unit 42 may include a user interface unit on the cabinet cover 14 and be configured to input a predetermined command by the user or output certain information to the user. The control unit 40 may control components of the washing machine including the motor 28, the pulsator 24, the water supply valve unit 32, the operation unit 42, and the like. For example, when the user sets a washing course, a washing time, and the like through the operation unit 42, the control unit 40 may control the motor 28, the pulsator 24, the water supply valve unit 32 or the like to perform the washing process corresponding to the settings.

Meanwhile, the washing machine 1 may include a micro-bubble generator configured to receive wash water from the water supply valve unit 32, generate micro-bubbles, and supply the micro-bubbles to a washing space. The micro-bubble generator may include a dissolving unit 100 and a nozzle unit 200 (FIG. 2).

Figure 2:
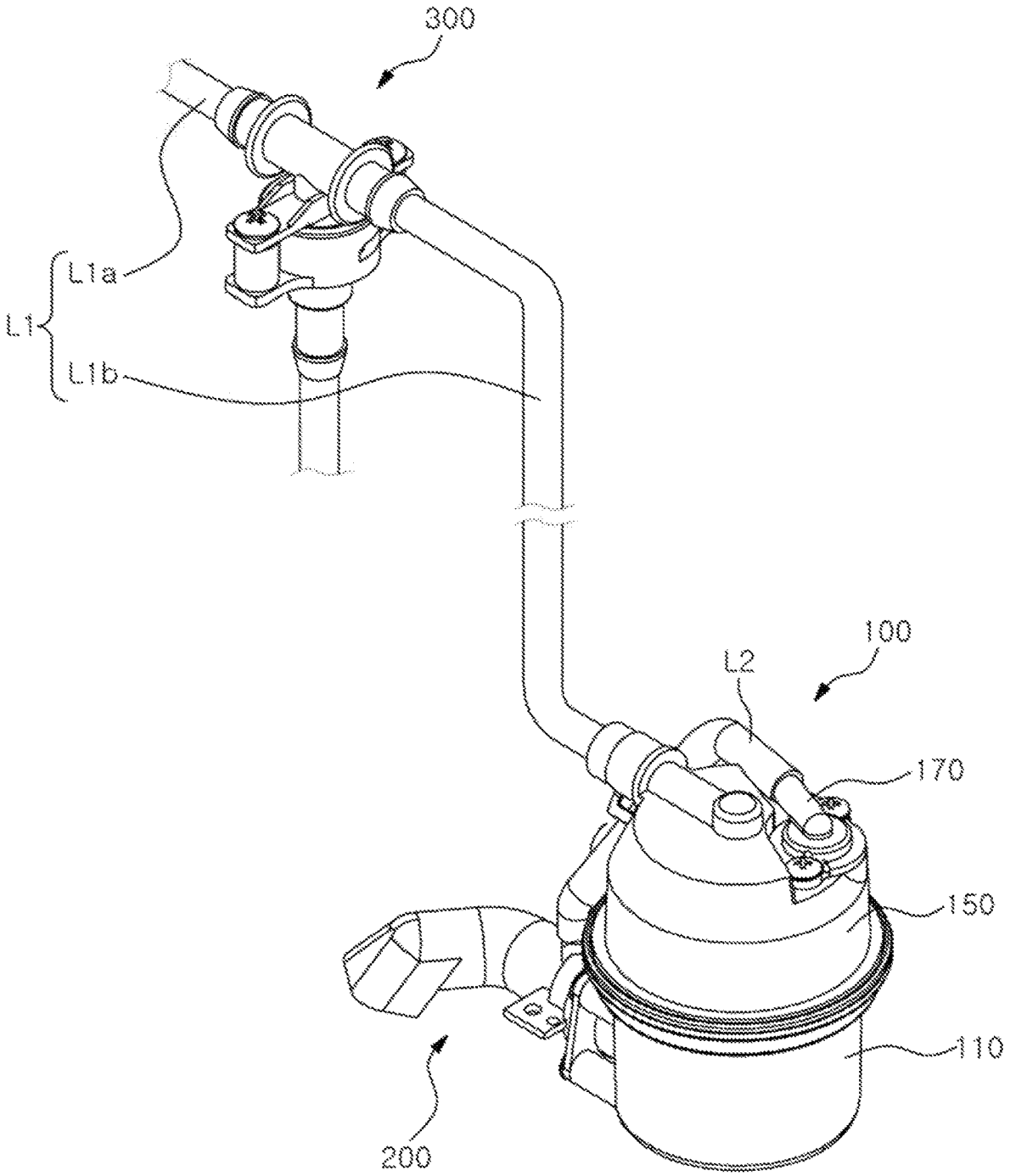
FIG. 2 is a view showing a configuration of an exemplary micro-bubble generator.

In addition, the washing machine 1 may include a water supply line L1 in FIG. 2 and a leaked water discharge line L2 in FIG. 2 for interconnecting the micro-bubble generator. The water supply line L1 may supply the wash water to the dissolving unit 100, and the leaked water discharge line L2 may connect the dissolving unit 100 with the nozzle unit 200 outside the dissolving unit 100 to provide wash water (e.g., excess wash water) from the dissolving unit 100 the nozzle unit 200.

The dissolving unit 100 may dissolve or mix gas into the wash water from the water supply valve unit 32. In this embodiment, the gas is exemplified by air in the dissolving unit 100, but the gas may be from a gas providing means (not shown), or a mechanism connected to or provided along with the dissolving unit 100.

The dissolving unit 100 may receive the wash water from the water supply line L1 connected to the water supply valve unit 32 and may generate bubbles in the wash water using the water supply pressure of the wash water from the water supply line L1 without using a power unit. In other words, the gas in the dissolving unit 100 may be dissolved or mixed in the wash water supplied into the dissolving unit 100, thereby generating bubbles in the wash water. The dissolving unit 100 may be above the inner basket 22 and on the upper portion of the washing machine 1. As an example, the dissolving unit 100 may be fixed to the cabinet cover 14.

The nozzle unit 200 may generate the micro-bubbles from water and gas in the dissolving unit 100 by supplying the wash water with gas. Specifically, the nozzle unit 200 may generate the micro-bubbles by splitting the bubbles generated as the gas dissolves, mixes or disperses in the wash water in the dissolving unit 100. This nozzle unit 200 may be connected at or near the input hole, and the wash water with the micro-bubbles therein may be directed into the inner basket 22 immediately after the micro-bubbles are formed. The micro-bubbles in the nozzle unit 200 gradually disappear over time or when they move along a predetermined flow path. In the present embodiment, as soon as the micro-bubbles are generated in the nozzle unit 200, the micro-bubbles are discharged into the inner basket 22. As a result, the amount of micro-bubble extinction may be minimized, and the effect of micro-bubble-containing wash water may be improved.

Hereinafter, a specific configuration of a micro-bubble generator according to an embodiment of the disclosure will be described with reference to the drawings.

Figure 3:
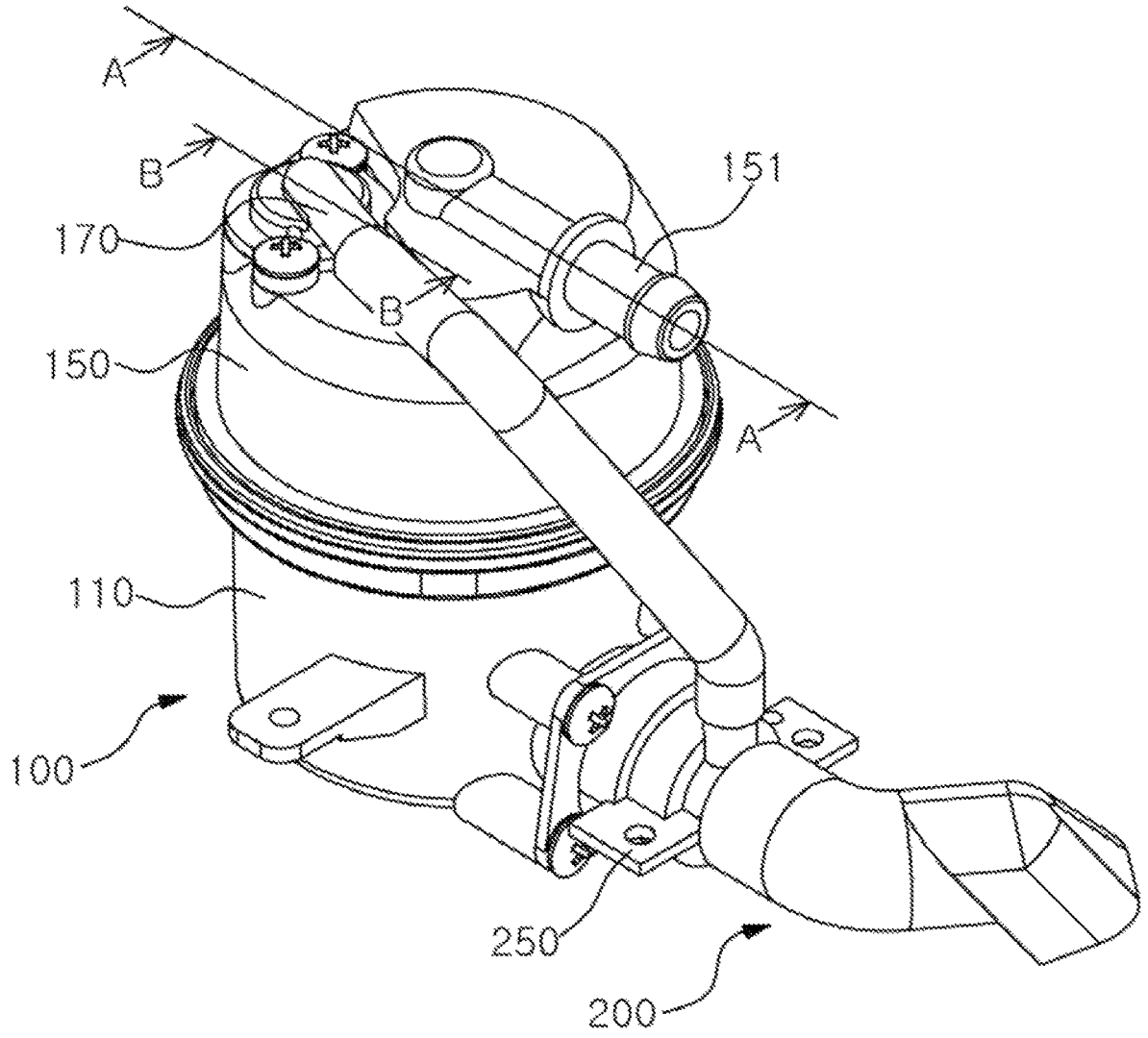
FIG. 3 is a perspective view of an exemplary dissolving unit and nozzle unit.
Figure 4:
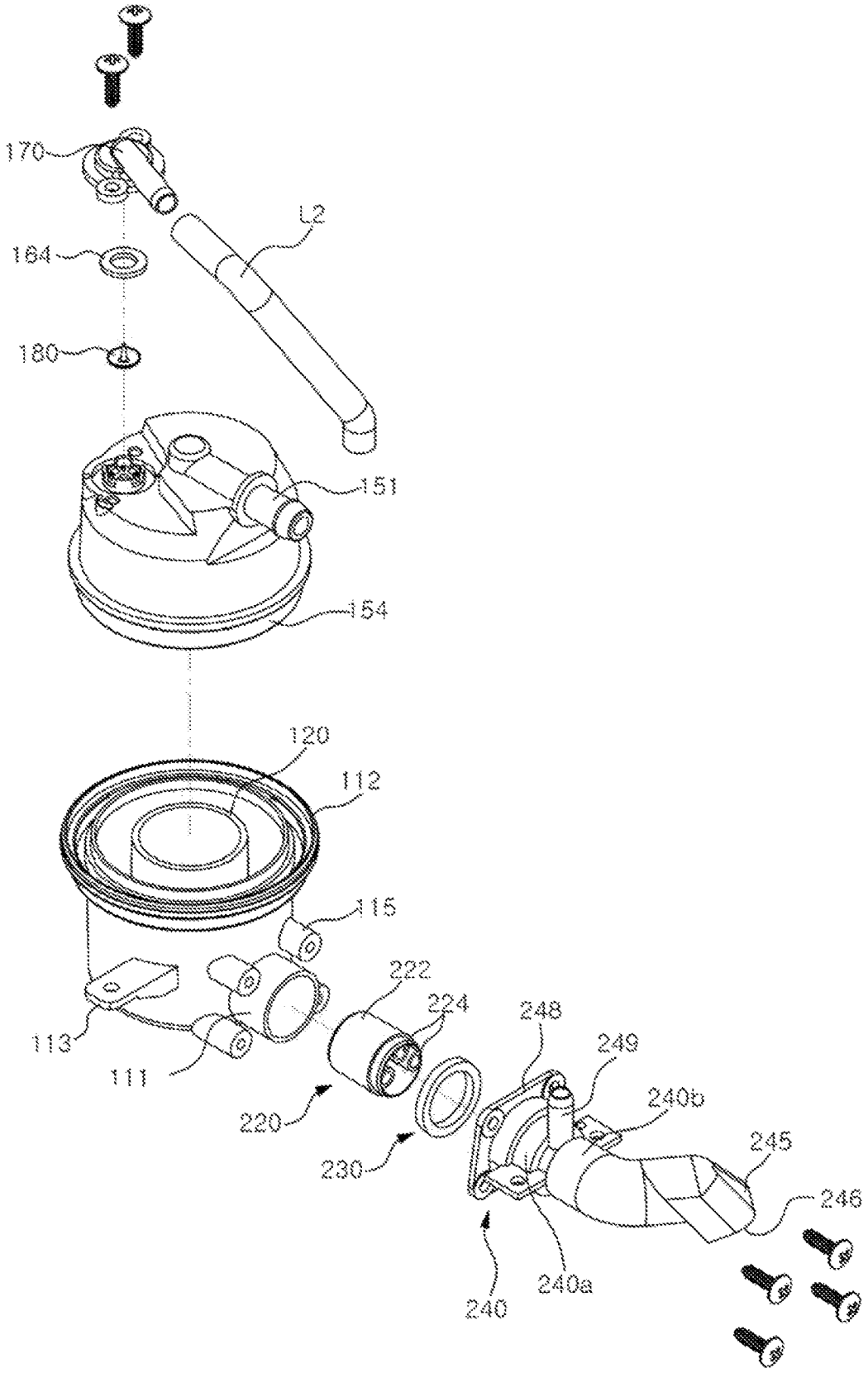
FIG. 4 is an exploded perspective view of the dissolving unit and the nozzle unit in FIG. 3.
Figure 5:
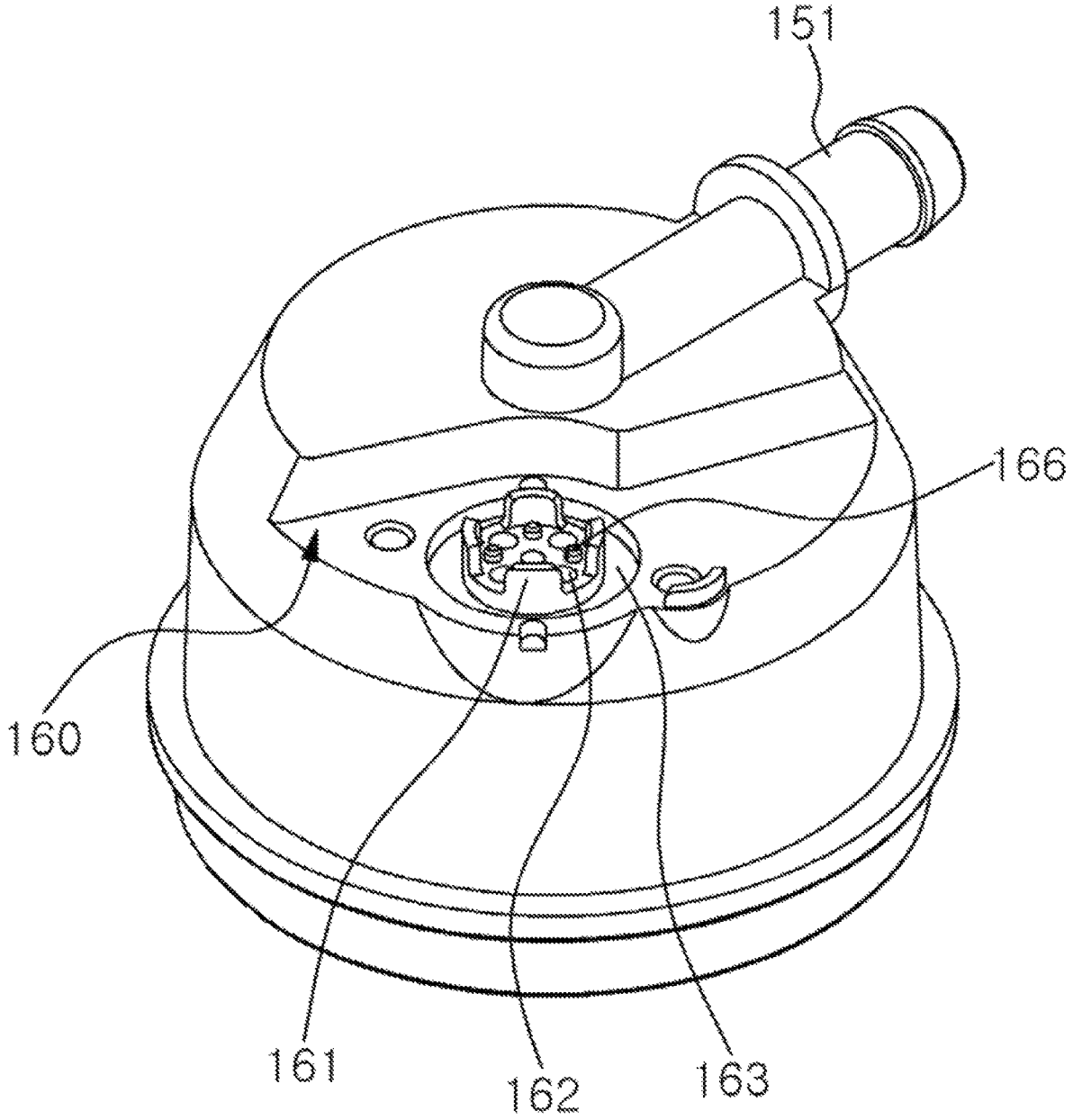
FIG. 5 is a view of an upper portion of the cap in the dissolving unit of FIG. 3.
Figure 6:
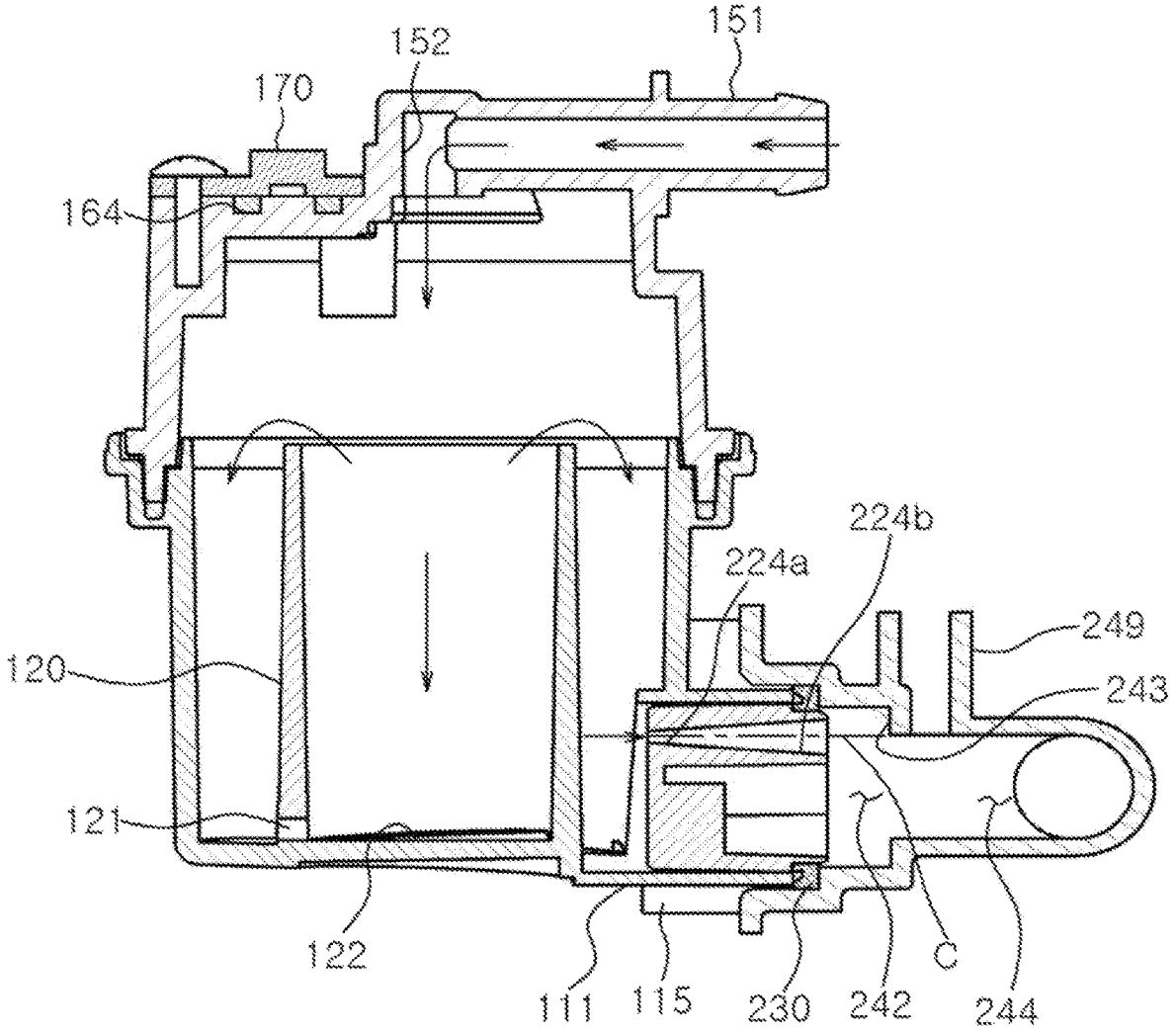
FIG. 6 is a cross-sectional view taken along the line A-A in FIG. 3.
Figure 7:
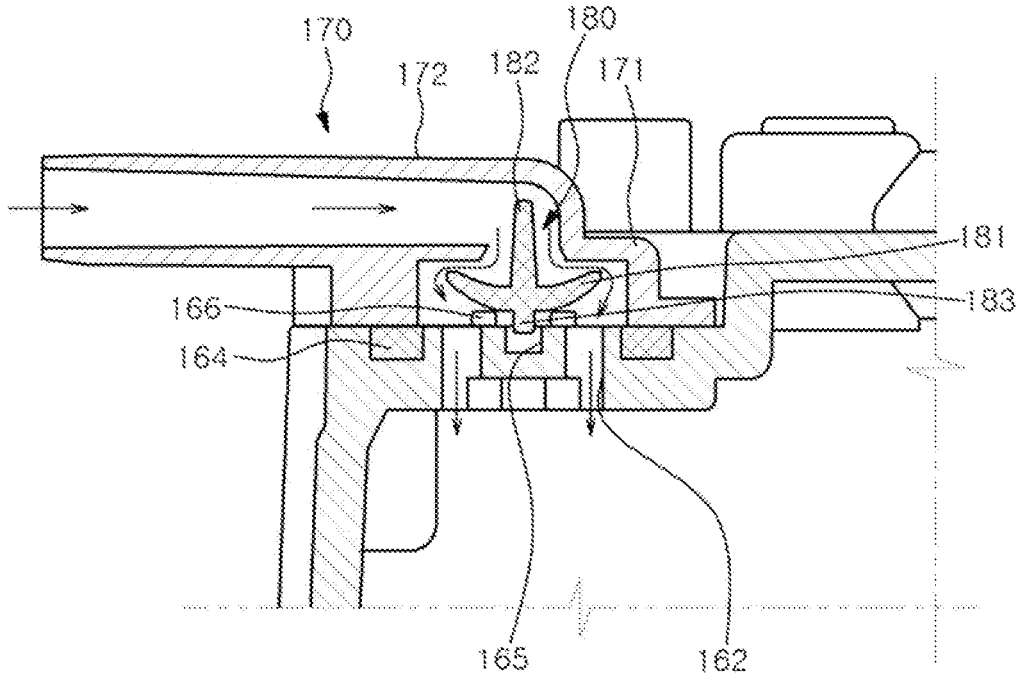
FIG. 7 is a cross-sectional view taken along the line B-B in FIG. 3.
Figure 7:
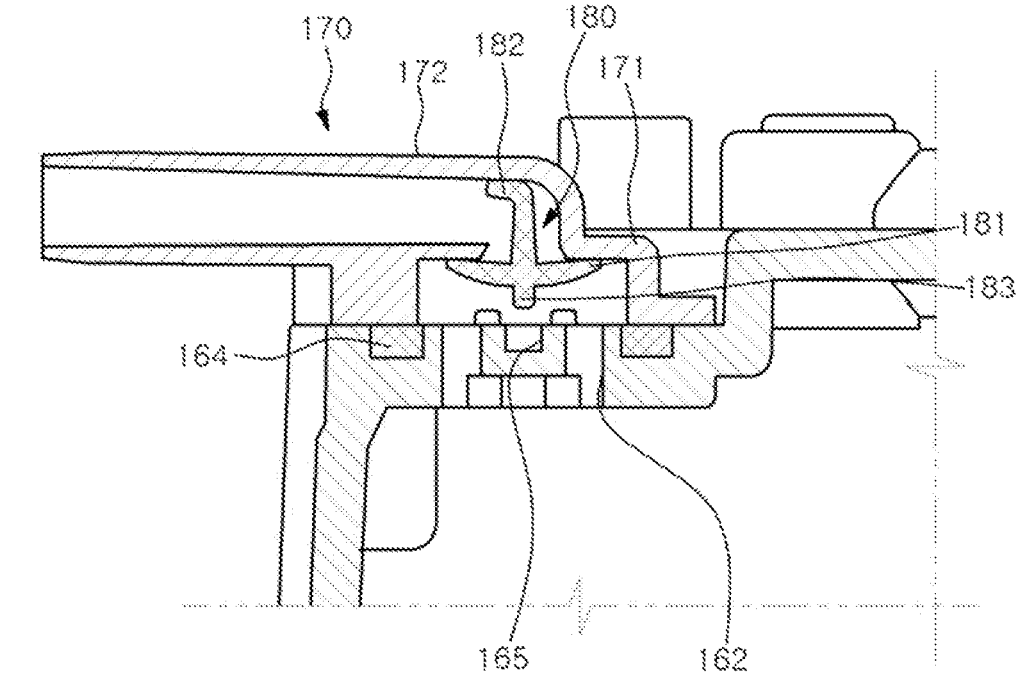
Figure 8:
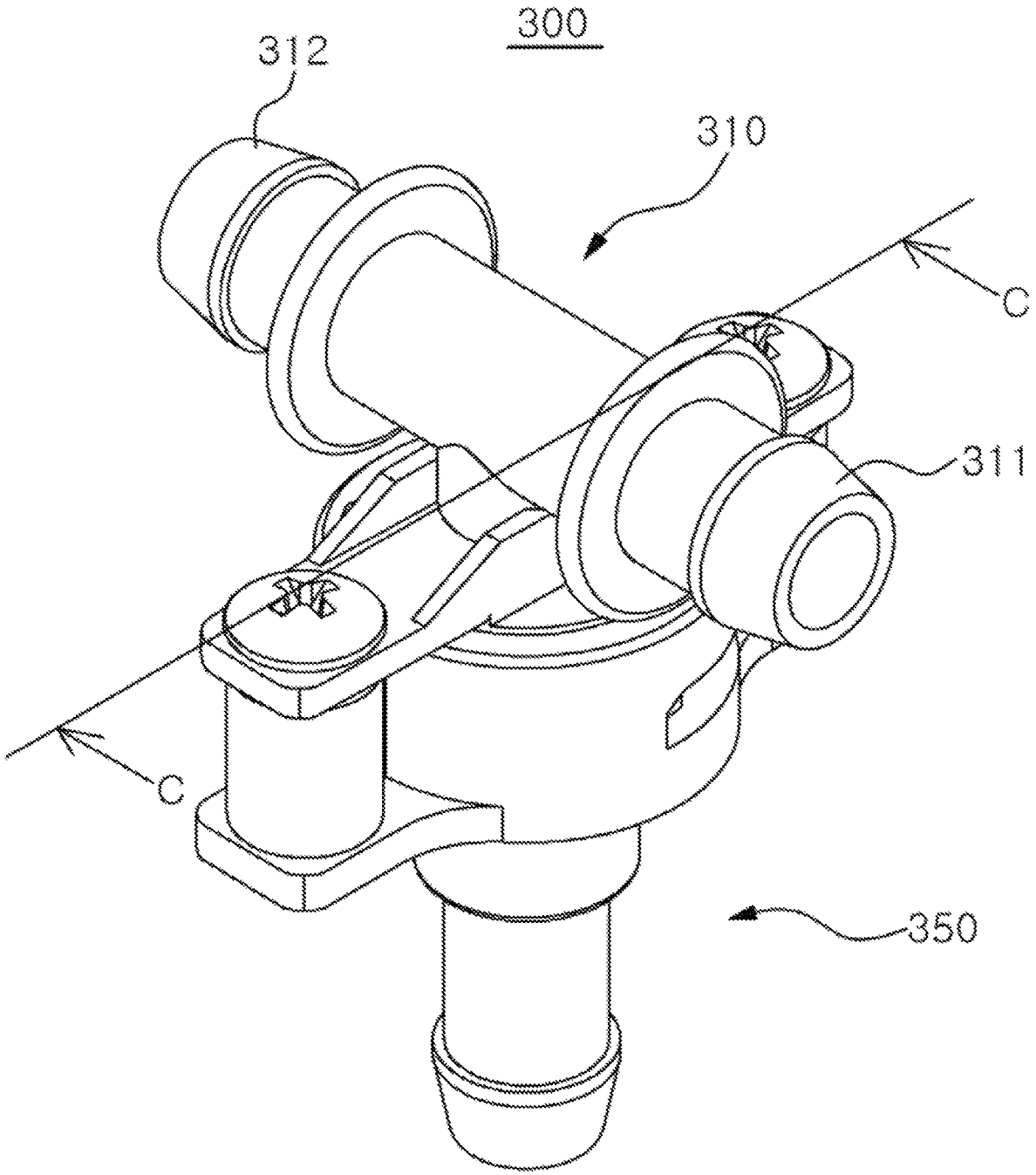
FIG. 8 is a perspective view of an exemplary pressure regulating unit.
Figure 9:
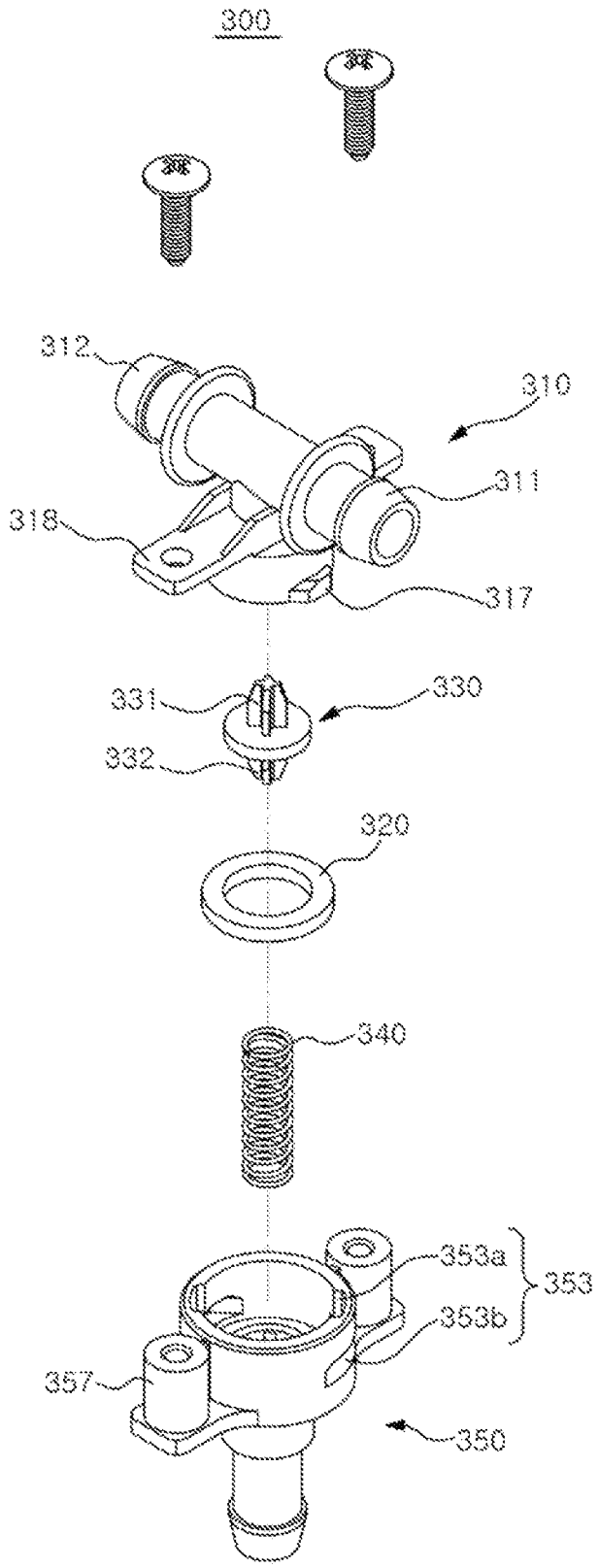
FIG. 9 is an exploded perspective view of the pressure regulating unit in FIG. 8.
Figure 10:
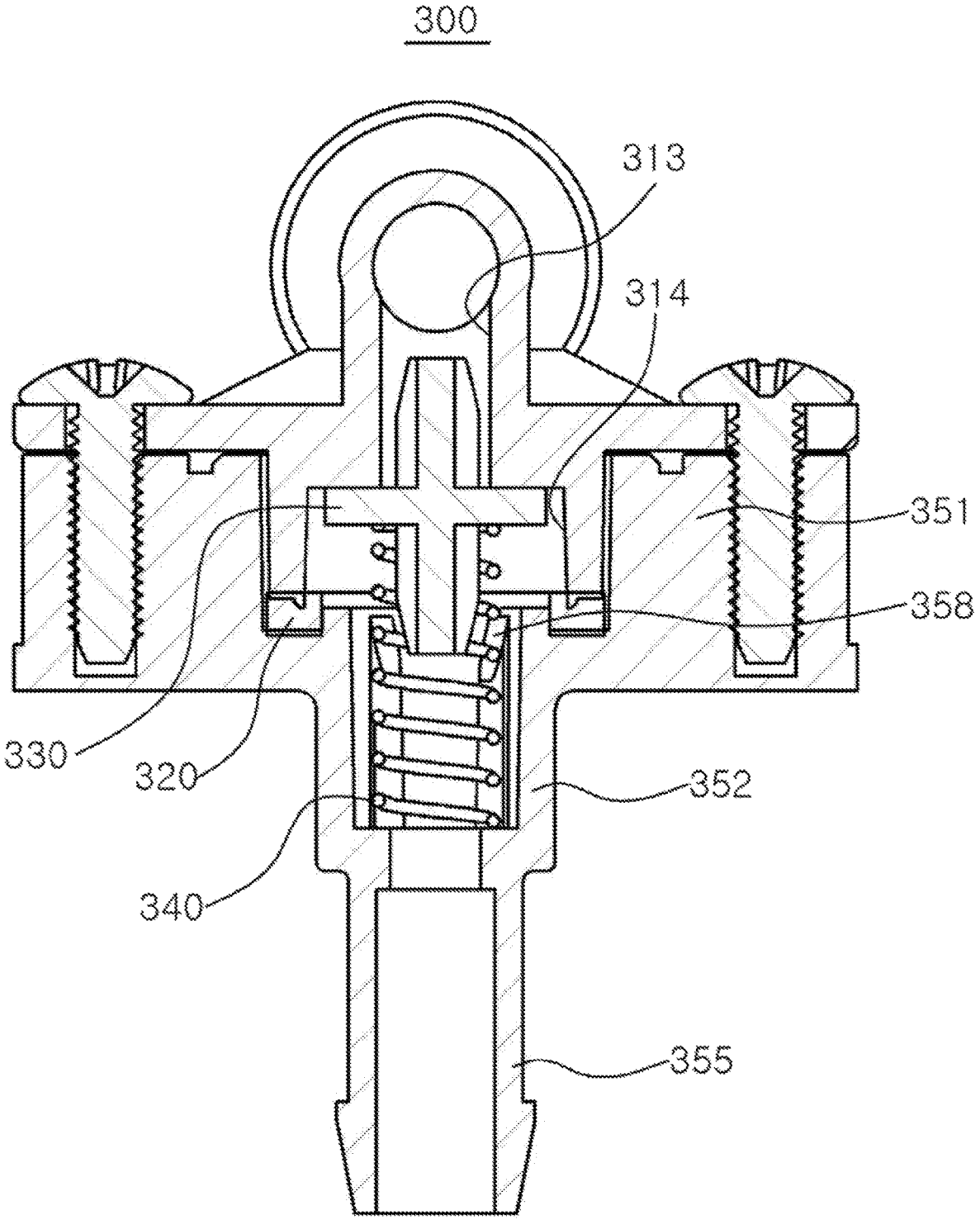
FIG. 10 is a sectional view taken along the line C-C in FIG. 8.

FIG. 2 is a view showing a configuration of an exemplary micro-bubble generator suitable for the washing machine shown in FIG. 1, FIG. 3 is a perspective view of an exemplary dissolving unit and an exemplary nozzle unit of the exemplary micro-bubble generator shown in FIG. 2, FIG. 4 is an exploded perspective view of the exemplary dissolving unit and the exemplary nozzle unit in FIG. 2, FIG. 5 is a view of the upper portion of the cap of the exemplary dissolving unit, FIG. 6 is a cross-sectional view taken along the line A-A in FIG. 3, FIG. 7 is a cross-sectional view taken along the line B-B in FIG. 3, FIG. 8 is a perspective view of the exemplary pressure regulating unit in FIG. 2, FIG. 9 is an exploded perspective view of the exemplary pressure regulating unit in FIG. 8, and FIG. 10 is a sectional view taken along the line C-C in FIG. 8.

Referring to FIGS. 2 to 10, the micro-bubble generator may include the dissolving unit 100 and the nozzle unit 200, as described above.

First, the dissolving unit 100 may receive the wash water and dissolve or mix the gas therein in the wash water. The dissolving unit 100 may be above the cabinet 10. As an example, the dissolving unit 100 may be fixed to the inner side wall of the cabinet cover 14. Hereinafter, the upper and/or lower direction(s) may mean the direction of gravity with reference to FIG. 1, and may be referred to as a vertical direction. Furthermore, the left and right direction(s) with reference to FIG. 1 may be referred to as a horizontal direction or a direction parallel to the paper surface.

Further, the dissolving unit 100 may be adjacent to the water supply valve unit 32.

Herein, referring to FIGS. 2 to 7, the dissolving unit 100 may include a dissolving body 110 and a cap 150 coupled to the top of the dissolving body 110.

The dissolving body 110 may have a tubular or cylindrical shape with an open upper end to receive the gas and wash water and to provide a dissolution space in which the gas is dissolved or mixed in the wash water. The term "dissolution space" refers to the space in which the wash water and the gas meet within the outer tube 510 to dissolve the gas. The dissolving body 110 may include a dissolved water drain portion 111 and a cap fixing portion 112.

The dissolved water drain portion 111 may supply the wash water in which the gas is dissolved or mixed to the nozzle unit 200, and may be on the outer circumferential surface of the dissolving body 110. In particular, the dissolved water drain portion 111 may be on the lower portion of the outer circumferential surface of the dissolving body 110.

The cap fixing unit 112 may be on the upper end of the dissolving body 110 and coupled with the dissolving body 110 and the cap 150 together. The cap fixing unit 112 may be or comprise a rib or lip extending outward along the outer circumferential surface of the upper end of the dissolving body 110. In addition, the cap fixing unit 112 may have a groove into which the lower end portion of the cap 150 is inserted.

A cabinet fixing unit 113 may be provided on the outer surface of the dissolving unit 100. The cabinet fixing unit 113 is configured to fix the dissolving unit 100 to the cabinet 10 and may be fastened to the cabinet 10. As an example, the cabinet fixing unit 113 may have a hole extending from the outer surface of the dissolving body 110 into which bolts or the like are inserted for fastening. The cabinet fixing unit 113 may be fastened to the inside of the cabinet cover 14.

A partition wall 120 (FIG. 4) may be inside the dissolving unit 100. The partition wall 120 extends a set distance upward from an inner bottom surface of the dissolving unit 110. The partition wall 120 may have a length corresponding to the vertical direction length of the dissolving body 110 so that the upper end or edge of the partition wall 120 may correspond to the upper end or edge of the dissolving body 110. At least a portion of the outer circumference of the partition wall 120 may be spaced apart from the inner circumferential surface of the dissolving body 110. For example, substantially the entire outer surface of the partition wall 120 may be spaced apart from the inner surface of the dissolving body 110. However, the outer surface of the partition wall 120 is not limited to being spaced apart from the inner surface of the dissolving body 110. For example, one side of the partition wall 120 may be in contact with the inner surface of the dissolving body 110, and another side may be spaced apart from the inner surface of the dissolving body 110. The dissolution space in the inner surface of the dissolving body 110 may be partitioned into an inner dissolution space and an outer dissolution space by the partition wall 120.

Herein, the volume of the inner dissolution space on the inner side of the partition wall 120 may be smaller than the volume of the outer dissolution space on the outer side of the partition wall 120. For example, the volume of the inner dissolution space may be less than one-third of the volume of the outer dissolution space. For example, the distance from the center of the inner side of the dissolving body 110 to the partition wall 120 may be less than the distance from the center of the inner side of the dissolving body 110 to the inner surface of the dissolving body 110. Thus, the amount of gas dissolved or mixed into the wash water in the dissolving unit 100 may be increased. Specifically, the gas in the dissolution space may be dissolved or mixed in the wash water supplied to the inner side of the partition wall 120 through the water supply line connection unit 151, and substantially, the gas may be dissolved or mixed while moving the wash water overflowing from the partition wall 120 to the outer dissolution space. That is, as the volume difference between the dissolving body 110 and the partition wall 120 increases, a space for storing the gas in the dissolving body 110 and a space where the gas is dissolved or mixed may increase. In this case, the inner diameter of the inner dissolution space may be twice or more the inner diameter of the space inside the water supply part 151. Accordingly, in relation to the amount of wash water supplied to the water supply unit 151, the inner dissolution space overflows the wash water to the outer dissolution space when a proper amount of wash water is received so that the bubbles may be effectively generated. When the inner diameter of the inner dissolution space is smaller than twice the inner diameter of the water supply portion 151, the amount of wash water in the inner dissolution space and overflowing to the outer dissolution space is reduced, and the bubble generation amount is not effectively achieved.

When the wash water supplied from the water supply line connection unit 151 is supplied to the inner side of the partition wall 120, and the wash water overflows from the partition wall 120, the wash water may fall into the outer dissolution space between the partition wall 120 and the dissolving body 110. In this case, the gas may be dissolved or mixed in the wash water in the dissolution space to generate bubbles.

The partition wall 120 may have a residual water discharge hole 121 therein. The residual water discharge hole 121 is a hole configured to drain wash water remaining inside the partition wall 120. The residual water discharge hole 121 is at the lower portion of the partition wall 120. For example, the residual water discharge hole 121 may be at the lowermost end of the partition wall 120. The diameter of the residual water discharge hole 121 may be smaller than the diameter of the upper end opening of the partition wall 120. Thus, the amount of wash water flowing into the partition wall 120 may be larger than the amount of wash water flowing through the drain, and the wash water may overflow the partition wall 120.

The bottom side of the inner side of the dissolving body 110 on the inner side of the partition wall 120 may have a different height, depending on the regions. Specifically, the bottom surface of the inner side of the dissolving body 110 inside the partition wall 120 may have the lowest region in contact with the residual water discharge hole 121. For example, the bottom side of the inner side of the dissolving body 110 inside the partition wall 120 may have a downward inclination toward the residual water discharge hole 121. In addition, the bottom of the inner side of the dissolving body 110 inside the partition wall 120 may be connected to the residual water discharge hole 121 and may have a residual water guide groove 122 in a shape crossing the inner side bottom surface of the dissolving body 110. The residual water guide grooves 122 may have the form of a groove shaped downwardly from the bottom of the inner side of the adjacent dissolving body 110. The residual water guide groove 122 has a set length and one end configured to interface with the residual water discharge hole 121 and another end extending to the partition wall 120 opposite from the residual water discharge hole 121. Accordingly, the wash water remaining on the inner side of the partition wall 120 may be effectively discharged toward the residual water discharge hole 121.

The residual water discharge hole 121 may be in a direction toward the center of the dissolved water drain portion 111 at the center of the inner side bottom surface of the partition wall 120 and toward a set angle (for example, 90 degrees or more). For example, the residual water discharge hole 121 may face the direction opposite from the dissolved water drain portion 111 by being opened at an angle of 180 degrees with respect to the direction of the dissolved water drain portion 111. Accordingly, a flow path having a set length may be formed until the wash water discharged to the residual water discharge hole 121 is discharged to the dissolved water drain portion 111. Thus, a sufficient amount of wash water supplied to the inner side of the partition wall 120 may flow into the outer dissolution space in a form that overflows through the upper end of the partition wall 120.

Meanwhile, the bottom side of the inner side of the dissolving body 110 on the outer side of the partition wall 120 may also have a different height depending on the region. Specifically, the bottom surface of the inner side of the dissolving body 110 on the outer side of the partition wall 120 may have a highest region in contact with the residual water discharge hole 121. For example, the bottom surface of the inner side of the dissolving body 110 on the outer side of the partition wall 120 may be downwardly inclined in the direction toward the dissolved water drain portion 111 from the residual water discharge hole 121. Accordingly, the residual water discharged from the residual water discharge hole 121 may be smoothly guided to the dissolved water drain portion 111.

The cap 150 may be fastened to the upper portion of the dissolving body 110 to shield an opening of the dissolving body 110. As the cap 150 and the dissolving body 110 may be fastened, the movement of the gas may be blocked so that the gas may be stored in the dissolution space of the dissolving unit 100, and thus the gas may be stored in the dissolving unit 100.

The cap 150 may further include a water supply direction switching unit 152 and a cap connection unit 154 as well as the water supply line connection unit 151 described above.

Specifically, the cap 150 including the water supply line connection unit 151 and the water supply direction switching unit 152 may be connected to the upper end of the dissolving body 110 to shield the dissolving body 110, the wash water may be supplied from the water supply line connection unit 151, and the water supply direction switching unit 152 may switch the direction of the wash water flowing through the water supply line connection unit 151 towards the interior of the partition wall 120.

The water supply line connection unit 151 may be connected to the water supply line L1 to supply the wash water provided from the water supply valve unit 32 into the dissolving unit 100.

The water supply line connection unit 151 may extend horizontally from the cap 150 to allow the wash water to be introduced horizontally into the cap 150. Specifically, the wash water supplied from the water supply valve unit 32 at one side (for example, the upper side) of the dissolving unit 100 may have a flow direction switched at least once in order to be horizontally supplied to the water supply line connection unit 151. Thus, the wash water may be introduced into the water supply line connection unit 151 in a horizontal direction, and then be switched inside the cap 150 and discharged to the inner space of the partition wall 120 in a vertical direction.

The water supply direction switching portion 152 may communicate with the discharging side or end of the water supply line connection unit 151, and has at least a portion thereof that is oriented in the vertical direction at the end of the horizontally-oriented water supply line connection unit 151. Thus, the supply direction switching portion 152 may switch the direction of the wash water from the water supply line connection unit 151 towards the partition wall 120.

The water supply direction switching portion 152 may be at a position corresponding to the center of the partition wall 120, such that the supplied wash water may be discharged into the partition wall 120.

For example, the water supply line connection unit 151 and the water supply direction switching portion 152 may be at an angle of 90 degrees or in an 'L' shape. This 'L' shape can prevent the wash water from the water supply line L1 from being directly injected into the partition wall 120. The wash water may be uniformly supplied by passing through the 'L' shape. On the other hand, when the water supply line connection unit 151 has a shape allowing only a linear flow of wash water, the wash water is directly injected from the water supply line L1. When being supplied by direct injection, the water supply is discharged relatively less uniformly. As a result, the overflow of the wash water in the partition wall 120 may occur irregularly, and the dissolution of the gas in the dissolving unit 100 may not be performed smoothly. However, in accordance with the embodiment shown in FIGS. 2-6, the wash water spreads out relatively uniformly after colliding with the side wall of the water supply direction switching portion 152 and discharging into the inner tube, and the wash water may be relatively uniformly supplied to the partition wall 120. Accordingly, it is possible to smoothly dissolve and/or mix the gas with the overflowing wash water.

Moreover, the water supply line connection unit 151 may be connected to an intermediate point of the water supply direction switching portion 152 along the vertical direction. Accordingly, the wash water supplied from the horizontal direction may enter the water supply direction switching portion 152 oriented in the vertical direction, may hit the inner wall of the water supply direction switching portion 152, and may be spread out along the vertical direction of the water supply direction switching portion 152. Specifically, the wash water may be not directly injected into the partition wall 120 by changing from the horizontal direction to the vertical direction, but may be spread in the vertical direction by colliding against the inner wall of the water supply direction switching portion 152. Accordingly, the flow of the wash water may be made more uniform. Since the wash water is more uniformly supplied to the partition wall 120, the gas in the dissolution space may be more uniformly supplied to the wash water, and the bubbles may be more uniformly formed.

In summary, the dissolving unit 100 may receive the wash water flowing from the water supply valve unit 32 in the horizontal direction and change the flow of the wash water to the vertical direction, and it is possible to prevent direct injection of water from the water supply valve unit 32 into the interior of the partition wall 120.

The gas supply unit 170 may be spaced apart from the water supply line connection unit 151 and have a set angle with respect to the water supply direction switching unit 152. The gas supply unit 170 may supply the gas into the internal space of the dissolving unit 100.

The gas supply unit 170 may comprise at least in part a pipe and have a cylindrical shape and/or a set length. The gas (e.g., air) supply unit 170 may also have a curved part or portion that is connected to the cap 150. For example, the gas supply unit 170 may include a cap fastening portion 171, which extends upward from one end connected to the cap 150, and a guide portion 172 that extends from the cap fastening portion 171. The guide portion 172 may be bent at an interface with the cap fastening portion 171 and extend in a direction away from the cap fastening portion 171. The cross-sectional area of the inner space of the cap fastening portion 171 may be larger than the cross-sectional area of the inner space of the guide portion 172.

A gas supply unit fastening portion 160 may be formed in an upper portion of the cap 150. The gas supply unit fastening portion 160 may be spaced apart from the water supply line connection unit 151 by a set angle and/or distance relative to the water supply direction switching unit 152. The gas supply unit fastening portion 160 may include a plurality of fastening ribs 161 and a supply hole 162. The fastening ribs 161 may be arranged in a ring shape corresponding to the inner surface of the cap fastening portion 171. The fastening ribs 161 may have a set interval between adjacent ribs 161. For example, four fastening ribs 161 may be provided along the circumference of the supply hole 162 with the set interval between adjacent ribs 161. When the gas supply unit 170 is in the gas supply unit fastening portion 160, the fastening rib 161 may be inserted into the air supply unit 170, such that the air supply unit 170 is aligned with the cap 150 at a set position.

A sealing groove 163 having a ring shape may be on the outer side circumference of the fastening rib 161. A gasket 164 having a shape corresponding to the sealing groove 163 may be in the sealing groove 163 between the cap 150 and the gas supply unit 170.

The supply hole 162 may be in the region inside the fastening ribs 161. The supply hole 162 may provide a path through which the gas from the gas supply unit 170 is supplied to the dissolution space. In addition, one or more supply holes 162 may be on the inside of the portion where the fastening ribs 161 are spaced apart from one another. For example, when four fastening ribs 161 are provided, four supply holes 162 may be in the space where the fastening ribs 161 is spaced apart from one another.

An opening and closing member (e.g., a valve) 180 may be between the cap 150 and the gas supply unit 170. The opening and closing member 180 may comprise an elastically deformable material such as synthetic rubber, silicone, synthetic resin and the like. The opening and closing member 180 may include a shield unit (or stopper) 181 having a set area. The shield unit 181 may have an area larger than the area of the flow path in the guide portion 172 above the cap fastening portion 171. The lateral area of the shield unit 181 may correspond to (e.g., be slightly smaller than) the inside region of the fastening ribs 161, so that the opening and closing member 180 may move up and down in the space inside the cap fastening portion 171.

When the wash water is supplied to the dissolving unit 100, the internal pressure of the dissolving unit 100 increases as the internal space of the dissolving unit 100 fills with the wash water. In addition, due to the water pressure of the wash water flowing into the interior space of the dissolving unit 100, a portion of the wash water may flow into the supply hole 162. Thus, gas and/or wash water flowing in the direction of the bottom surface of the shield unit 181 and passing through the supply hole 162 may exert an upward force on the shield unit 181 so that the shield unit 181 may shield the gas supply unit 170 come into contact with the step in the cap fastening portion 171 or between the cap fastening portion 171 and the guide portion 172. Otherwise, the opening and closing member 180 may move downward, and the may be supplied to the dissolving unit 100 through the open gas supply unit 170.

The shield unit 181 may have a downward convex shape. The shield unit 181 may have a downward convex or upward concave shape. Thus, when pressure is applied to the opening and closing member 180 from the downward direction to the upward direction (i.e., from the dissolving unit 100 to the guide portion 172), the rim of the upper surface of the shield unit 181 may be elastically deformed to a certain level while contacting the upper inside surface of the cap fastening portion 171, thereby shielding the flow path of the gas supply unit 170 and blocking gas inflow and wash water discharge into the guide portion 172. In addition, when the opening and closing member 180 moves downward, the bottom surface of the opening and closing member 180 may be spaced apart from the supply hole 162 by a support protrusion or ring 166, so that gas may be effectively supplied to the dissolving unit 100.

The shield unit 181 may have a modulus of elasticity such that it does not enter the guide portion 172, even when the wash water is supplied at the set maximum water pressure.

An upper protrusion 181 protruding upward may be on the upper surface of the opening and closing member 180. The upper protrusion 181 may have a set length and may be in the inner space of the gas supply unit 170 above the cap fastening portion 171. When the opening and closing member 180 contacts the gas supply unit 170, the upper end of the upper protrusion 181 may contact with the inner surface of the gas supply unit 170 and elastically deform to a certain level. As a result, the upward movement of the shield unit 180 may be restricted to a certain level. In addition, when the pressure acting on the opening and closing member 180 is removed, the opening and closing member 180 may be prevented from falling off or out of the gas supply unit 170, and after the supply of the wash water is terminated, the flow path of the gas supply unit 170 is quickly opened so that air may be re-introduced into the inner portion of the dissolving unit 100.

A lower protrusion 183 extending downward may be on the lower surface of the opening and closing member 180. The lower projection 183 may be in the central region (e.g., the center) of the lower surface of the opening and closing member 180. A guide groove, hole or depression 165 may be in region of the gas supply unit fastening portion 160 corresponding to the lower projection 183 inside the fastening ribs 161. The lower projection 183 may prevent the opening and closing member 180 from tilting or leaning.

The opening and closing member 180 may have a shape resembling an inverted umbrella.

The cap 150 may have support protrusions 166 inside the fastening ribs 161. The support protrusions 166 may support the bottom surface of the shield unit 181 (for example, the bottom surface of the shield unit 181 along the circumference of the lower protrusion 183) when moving downwardly. The support protrusions 166 may be in one or more spaces between adjacent supply holes 162. For example, when four supply holes 162 are provided, four support protrusions 166 may be in the spaces between the supply holes 162. The support protrusions 166 may support the bottom surface of the opening and closing member 180 to prevent the opening and closing member 180 from closing the supply hole 162.

The cap connection unit 154 may couple and fix the cap 150 and the dissolving body 110 together. The cap connection unit 154 may be a rib or ring extending downward along the outer circumferential surface at the lower end of the cap 150 and may fit to or mate with the cap fixing unit 112.

In this case, in order to couple and fix the dissolving body 110 and the cap 150 together, the cap connection unit 154 of the cap 150 may be inserted into the cap fixing unit 112 of the dissolving body 110. The dissolving body 110 and the cap 150 may be sealed while the cap fixing unit 112 and the cap connection unit 154 are fastened. As an example, the cap fixing unit 112 and the cap connection unit 154 may be thermally fused so that the dissolving unit 100 may be sealed. However, the cap fixing unit 112 and the cap connection unit 154 are not limited to a rib or ring shape, but may comprise a flange or the like.

Next, the nozzle unit 200 may generate micro-bubbles by receiving the wash water in which the gas is dissolved or mixed from the dissolving unit 100. Specifically, the nozzle unit 200 may break the bubbles contained in the wash water supplied from the dissolving unit 100 into micro-bubbles, or increase the amount of bubbles in the wash water to be discharged into the inner basket 22.

The nozzle unit 200 includes a micro-bubble generator 220 configured to generate the micro-bubbles, a gasket 230 and a nozzle portion 240 for discharging the wash water containing micro-bubbles into the inner basket 22.

The nozzle unit 200 may be connected directly to the dissolved water drain portion 111 at one side of the dissolving unit 100.

The dissolved water drain portion (e.g., drain) 111 may be provided such that the flow path formed on the inner side has a set cross-sectional area and a length. Specifically, the dissolved water drain portion 111 may correspond to the size, shape, and cross-sectional area of the micro-bubble generator 220 so that the micro-bubble generator 220 may be inserted into the drain 111.

In the dissolving unit 100, a nozzle portion connection unit 115 may be on the outside circumference of the dissolving body 110 adjacent or proximate to the dissolved water drain portion 111. The nozzle portion connection unit 115 may be connected to the body connection unit 248 of the nozzle portion 240 to fix the nozzle portion 240 to the dissolving unit 100. The nozzle portion connection unit 115 may receive one or more fasteners fastening the nozzle portion 240 to the dissolving body 110, and the nozzle portion connection units 115 may extend from the outer circumferential surface of the dissolving body 110 on opposite sides (e.g., above and below, left and right, etc.) of the dissolved water drain portion 111. Each nozzle portion connection unit 115 may include a hole into which a fastening member (e.g., a screw) may be inserted. A total of four nozzle portion connection units 115 may be arranged in a ring, square or rectangular shape on the outer circumferential surface of the dissolving body 110 adjacent or proximate to the dissolved water drain portion 111.

In addition, an auxiliary fixing unit 250 for fixing the nozzle unit 200 to the cabinet 10 may be provided on the outside surface of the nozzle portion 240. As an example, the auxiliary fixing unit 250 may be flat or planar, or have a plate shape and/or a set area, and the auxiliary fixing unit 250 may have a hole into which a fastening means such as a bolt or a screw is inserted.

The micro-bubble generator 220 may be inserted into the dissolved water drain portion 111. In this case, the dissolved water drain portion 111 may have a shape protruding to a set distance to the outside of the dissolving body 110, thereby forming an outer dissolution space, and one end of the micro-bubble generator 220 may have a shape suitable for being inserted into the outer dissolution space. The micro-bubble generator 220 includes a housing 222 that can be accommodated in the dissolved water drain portion 111 and decomposition units 224 disposed at set intervals along the circumference of the housing 222 on the inside of the housing 222. In an embodiment of the disclosure, three decomposition units 224 are in the housing 222, but not limited to three, and one or more decomposition units 224 may be present. Since the micro-bubble generator 220 may be configured to be inserted into the dissolved water drain portion 111, the nozzle unit 200 may be coupled to the dissolving unit 200 with a compact shape in which the length protruding to the outside from the dissolving unit 200 is minimized.

The decomposition unit 224 may be or comprise a cone (e.g., a tube whose diameter is widened along the traveling direction of the fluid flowing from the outer dissolution space), and may indicate a flow path inside the housing 222. The micro-bubble generator 220 may include a plurality of decomposition units 224, and the decomposition units 224 may communicate with the outer dissolution space. In addition, the wash water entering the decomposition unit 224 from the outer dissolution space may pass through the decomposition unit 224 to generate micro-bubbles. In this case, the opening at the side where the wash water is introduced into the decomposition unit 224 may be called the inlet 224*a* of the decomposition unit 224, and the opening at the side where the wash water is discharged from the decomposition unit 224 may be called the outlet 224*b*. The inlet 224*a* and the outlet 224*b* may be centered on one another, and the inlet 224*a* may have a smaller cross-sectional area than the outlet 224*b*. Thus, the decomposition unit 224 may be extend from the inlet 224*a* to the outlet 224*b* and have a tapered cross-sectional shape.

The wash water in which the gas is dissolved or mixed may contain relatively large bubbles, and such wash water may flow from the outer dissolution space into the inlet 224*a* of the decomposition unit 224 to the outlet 224*b*. The wash water flowing into the inlet 224*a* from the outer dissolution space may be introduced at an increased flow rate, as the diameter of the inlet 224*a* communicating with the outer dissolution space is orders of magnitude less than the diameter of the drain 111. And, the wash water passing through the decomposition unit 224 may gradually expand, and at the same time, the flow rate of the wash water may decrease and the pressure may increase. As a result, the bubbles in the wash water are split to generate micro-bubbles, or new bubbles may be generated in the wash water. In this case, one end of the micro-bubble generator 220 is inserted into the outer dissolution space. The outer dissolution space may have dimensions such that the volume of the region into which the wash water flows into the micro-bubble generator 220 may be smaller than the volume of the adjacent upstream region. Accordingly, the wash water flowing in the direction of the micro-bubble generator 220 may be pressurized before entering the micro-bubble generator 220. As the pressure increases, the amount of bubble generation in the wash water may increase. Thus, the pressure of the wash water may be increased before being introduced into the micro-bubble generator 220 to supply the wash water to the decomposition units 224.

A gasket 230 may be around the outlet side of the decomposition units 224 of bubble generating portion 220. The gasket 230 may press at the end of the dissolved water drain portion 111 while surrounding the bubble generating portion 220 at the inside of the nozzle portion 240 when the bubble generating portion 220 is in the nozzle portion 240. Accordingly, the gasket 230 may be pressurized and fixed by the dissolved water drain portion 111 and the nozzle portion 240, thereby preventing leakage of micro-bubbles and/or the micro-bubble-containing wash water. The gasket 230 may be or comprise an O-ring, but is not limited thereto.

The nozzle portion 240 may be coupled to the dissolved water drain portion 111 so that the bubble generating portion 220 may be accommodated and fixed in place in the dissolved water drain portion 111, and may serve to discharge the wash water containing micro-bubbles into the inner basket 22. The nozzle portion 240 may include a first part 240*a* forming a first mixing space 242 and a second part 240*b* connected to the first part 240*a*, configured to discharge the wash water containing micro-bubbles toward an upper portion of the inner basket 22. The first part 240*a* and the second part 240*b* may have blocking surfaces 243 and 245, which block at least a portion of the flow of wash water from the decomposition units 224 so as not to directly inject the wash water into the inner basket 22, and may include micro-bubble mixing portions 242 and 244 configured to mix the micro-bubbles generated in the decomposition unit 224 with the washing water that has been discharged from the decomposition unit 224 and slow down the flow of the wash water.

Specifically, the first part 240*a* may include a first mixing space 242 communicating with the dissolving unit 224 and having the same cross-sectional area as the cross-sectional area of the housing 222, and a first blocking surface 243 that alters the flow of the wash water. Similarly, the second part 240*b* may include a second mixing space 244 connected to the first mixing space 242 and having a smaller cross-sectional area than the first mixing space 242, and a second blocking surface 245 that alters the flow of the wash water flowing in the second mixing space 244.

The first mixing space 242 and the second mixing space 244 may increase the amount of the micro-bubble generation by preventing direct injection of the wash water into the inner basket 22, while maximizing the flow path of the wash water through the nozzle portion 240.

The first mixing space 242 may have a diameter corresponding to the diameter of the bubble generating portion 220 and a cylindrical shape corresponding to the external shape of the bubble generating portion 220. The first mixing space 242 is a space where the wash water having the micro-bubbles from the decomposition unit 224 is mixed with wash water that has been previously discharged from the decomposition unit 224 and whose flow rate has slowed down. Specifically, after passing through the decomposition unit 224, the wash water with a slow flow rate (e.g., that strikes the first blocking surface 243) may be discharged to the first mixing space 242, and some of the wash water with the slow flow rate may stay in the first mixing space 242. In this case, the wash water continuously injected from the decomposition unit 224 and the wash water staying in the first mixing space 242 may collide and mix, the bubbles in the wash water may be further split, and the micro-bubbles may be more uniformly distributed in the wash water.

The second mixing space 244 allows the wash water discharged from the first mixing space 242 to stay for a certain period of time. At this time, additional micro-bubbles may be generated while the wash water in the second mixing space 244 collides with the wash water that is rapidly discharging from the first mixing space 242.

In the embodiment, the second mixing space 244 may have a smaller diameter than the first mixing space 242, and the first mixing space 242 and the second mixing space 244 may have a step at an interface between them. In this case, one side of the step leading from the first mixing space 242 to the second mixing space 244 may be the first blocking surface 243. The step may have an edge at a height corresponding to the center line 'C' connecting the center of the inlet 224*a* of the decomposition unit 224 and the center of the outlet 224*b*.

The first blocking surface 243 may extend from the side of the first mixing space 242 and may be parallel to the outlet 224*b* side of the decomposition unit 224, or be inclined so as to protrude or extend toward the decomposition unit 224. As an example, the first blocking surface 243 may be a predetermined distance from the outlet of the nozzle portion 240, and may function as one side forming the first mixing space 242. In this example, the end of the first blocking surface 243 may be at a height corresponding to 90% to 110% of the distance from the side (e.g., the outermost periphery or outer circumference) of the first mixing space 242 to the extension line of the centerline C of the decomposition unit 224. The embodiment shown in FIGS. 4 and 6 is an example in which the end of the first blocking surface 243 is at a height corresponding to the extension line of the center line C of the decomposition unit 224. As such, the first blocking surface 243 enables simplifying the configuration of the nozzle portion 240, while blocking the direct injection and discharge of the wash water from the decomposition unit 224 and maximizing the size of the flow path through which the wash water with micro-bubbles therein is supplied.

The wash water will slow down in the first mixing space 242, where the flow path widens from the narrower decomposition units 224. The first blocking surface 243 may prevent some of the wash water from discharging by direct injection from the decomposition unit 224 to the second mixing space 244. Therefore, the wash water, part of which is slowed and temporarily retained in the first mixing space 242 by the first blocking surface 243, may collide with the wash water injected from the dissolving unit 224, striking the first blocking surface 243 and then entering into the first mixing space 242, thereby generating additional micro-bubbles. The first blocking surface 243 may be formed at an angle to prevent the direct injection of the wash water discharged from the decomposition unit 224. By preventing the direct injection, it is possible to allow the micro-bubbles generated in the decomposition unit 224 to spread evenly throughout the wash water and/or to prevent the micro-bubbles from being discharged immediately without being dissolved or suspended in the wash water for a sufficient time. Also, it is possible to generate additional micro-bubbles in the first mixing space 242.

In summary, according to the nozzle unit 200 of an embodiment of the disclosure, when the bubbles introduced from the dissolving unit 100 pass through the expanding decomposition unit 224, the pressure increases and the flow slows down at the same time. Accordingly, the bubbles may then be split into micro-bubbles, and additional (micro) bubbles may be generated. The slow-flow, micro-bubble-containing water passing through the decomposition unit 224 may be discharged to the first mixing space 242. In this case, a portion of the micro-bubble-containing water may be relatively slowly discharged from the first mixing space 242 to the second mixing space 244, and another portion of the micro-bubble-containing water may collide with the first blocking surface 243 to prevent the direct injection. The micro-bubble-containing water colliding with the first blocking surface 243 may not be directly injected into the second mixing space 244, but may be injected into the first mixing space 242, so that a collision may occur between the bubbles in the water in the first mixing space 242, and then the bubbles may be split into micro-bubbles, and the amount of bubbles and/or micro-bubbles may increase. Thus, since the micro-bubbles may collide with the first blocking surface 243 so as not to be fed directly into the second mixing space 244 by direct injection, and additional micro-bubbles may be generated by the first blocking surface 243, the amount of micro-bubbles may increase.

The micro-bubbles in the first mixing space 242 are discharged to the second mixing space 244. The second mixing space 244 may serve as a guide to direct the micro-bubbles to a discharging position where they are discharged into the inner basket 22. The second blocking surface 245 may be at a location in the second mixing space 244 near or approaching the discharging position. The micro-bubbles discharged from the first mixing space 242 collide with the second blocking surface 245, and the direct injection may be prevented once more. The bubbles discharged in the bubble state from the first mixing space 242 may collide with the second blocking surface 245 and may be split into micro-bubbles, which may increase the amount of micro-bubble generation. In addition, since the second blocking surface 245 may be near the discharging position, the micro-bubbles discharged from the second blocking surface 245 may be supplied directly into the inner basket 22. In addition, the nozzle portion 240 may further include a discharging portion 246 and a body connection unit 248.

The wash water containing the micro-bubbles may be discharged to the washing space in the inner basket 22 through the discharging portion 246. The discharging portion 246 may have a wider cross-section toward the discharging port, and the second blocking surface 245 may be adjacent to the discharging portion 246. In addition, the discharging portion 246 may be at a predetermined angle between the second mixing space 244 the inner basket 22 (e.g., with regard to a central axis of the inner basket 22, a lowermost [horizontal] surface of the inner basket 22, etc.). The second blocking surface 245 may be at a predetermined angle with regard to the inner basket 22 so as to correspond to the discharging portion 246. Since the discharging portion 246 is angled and open or directed toward the inner basket 22, it may prevent scattering of the micro-bubbles discharged to the inner basket 22.

The body connection unit 248 may include a surface extending from one end of the nozzle portion 240 in the vertical direction (e.g., perpendicular to the flow path of water in the nozzle unit 200) and may include holes at a position corresponding to the nozzle connection units 115 on the exterior surface of the body portion 110. Fastening members (e.g., screws, bolts, etc.) may pass through or be inserted into the holes. Thus, the body connection unit 248 is brought into contact with the nozzle connection units 115, and the fastening members may be inserted into or pass through the holes into the nozzle portion connection units 115 to fasten the dissolving body 110 and the nozzle portion 240.

A leaked water inflow portion 249 may be in or on an upper surface of the nozzle portion 240. The leaked water inflow portion 249 may have a vertical longitudinal direction. The leaked water inflow portion 249 may be in the second portion 240*b* of the nozzle 240. Alternatively, the leaked water inflow portion 249 may be in first portion 240*a* of the nozzle 240, or between the first and second portions 240*a* and 240*b*. The leaked water inflow portion 249 may be connected to the gas supply unit 170 by a tube or piping. When the wash water is supplied to the dissolving unit 100 from the water supply line connection unit 151, water may leak from the gas supply unit 170. For example, when the wash water is supplied to the dissolving unit (100), the gas supply unit 170 may be shielded by the opening and closing member 180. However, at the beginning of the wash water supply, the opening and closing member 180 may not completely shield the gas supply unit 170, such that water may leak into the gas supply unit 170. In addition, in the course of use, the opening and closing member 180 may deteriorate or become dirty, the responsiveness of the opening and closing member 180 may deteriorate, and water may leak into the gas supply unit 170 even when the opening and closing member 180 is closed (i.e., shields the gas supply unit 170). In this case, the wash water leaking into the gas supply unit 170 may flow into the leaked water inflow portion 249 and be discharged to the inner basket.

That is, when the wash water is supplied to the dissolving unit 100, the flow path of the gas supply unit 170 may be shielded by the opening and closing member 180, and the wash water may pass through the inner portion of the dissolving unit 100 and the nozzle unit 200 and be discharged to the inner basket 22 after the micro-bubbles are generated. In this case, while the wash water flows, wash water leaking into the gas supply unit 170 may flow into the nozzle unit 200 through the leaked water inflow portion 249 and may be discharged into the inner basket 22 together with the micro-bubbles. And, when the supply of wash water to the dissolving unit 100 stops, the gas may be effectively supplied from two directions (e.g., from the gas supply unit 170 and/or the path in which the micro-bubbles are discharged through the nozzle unit 200 to the inner portion of the dissolving unit 100). As described above, the micro-bubble generator according to embodiments of the present disclosure may effectively generate micro-bubbles, even though the dissolving unit 100 and the nozzle unit 200 have a compact structure. In addition, the path through which leaking water may be discharged when the wash water is supplied and the path through which the gas may be supplied when the wash water is not supplied may discharge the leaking water and supply the gas effectively.

In an embodiment of the disclosure, the principle of the wash water flowing in, through and/or from the nozzle unit 200 may be summarized below. When the wash water from the dissolving unit 100 passes through the decomposition unit 224, the bubbles in the wash water may be split into micro-bubbles, and/or additional micro-bubbles may be created. The wash water discharged from the decomposition unit 224 to the first mixing space 242 may be blocked or redirected by a first blocking surface 243 in the first mixing space 242, and the wash water may stay or reside for a predetermined time in the first mixing space 242 after striking the first blocking surface 243, such that additional micro-bubbles may generated, and the micro-bubbles may be more uniformly distributed in the wash water. In addition, the micro-bubbles passing through the first mixing space 242 may further collide with the second blocking surface 245 of the second mixing space 244, thereby preventing direct injection of the micro-bubble-containing wash water into the inner basket 22 and possibly increasing the amount of micro-bubble generation. Therefore, the amount of micro-bubble formation may be increased, to improve the washing power and rinsing power of the wash water.

The nozzle unit 200 may enter the inner side of the input hole of the cabinet cover 14 and be located above the inner basket 22. Accordingly, the micro-bubbles generated in the dissolving unit 100 and the nozzle unit 200 may be supplied into the inner basket 22 where washing is performed without being extinguished. Meanwhile, a pressure regulating unit 300 may be on or in the water supply line L1. The pressure regulating unit 300 includes a first body portion 310 connecting the water supply valve unit 32 and the dissolving unit 100 and a second body portion 350 discharging the wash water when the set pressure is applied.

The first body portion 310 may be on or in the water supply line L1 to supply the wash water from the water supply valve unit 32 to the dissolving unit 100. The first body portion 310 may include a wash water inflow portion 311 and a wash water supply portion 312.

The first body portion 310 may have one or more tubular or cylindrical shapes, and an upper flow path portion 313 and a regulated flow path portion 314 are in an inner central region of the first body portion 310. The upper flow path portion 313 and the regulated flow path portion 314 may be connected to each other and may be on or along the same central axis. The cross-sectional area of the regulated flow path portion 314 may be larger than the cross-sectional area of the upper flow path portion 313 and may be below the upper flow path portion 313.

The wash water inflow portion 311 may be connected to a front water supply line L1*a* (which is connected to the water supply valve unit 32) and may receive inflowing wash water. The wash water inflow portion 311 may be connected to the upper flow path portion 313.

The wash water supply portion (312) may communicate with the wash water inflow portion 311. The wash water supply portion 312 may be connected to the dissolving unit 100 through a rear water supply line L1*b* to supply the wash water from the wash water inflow portion 311 to the dissolving unit 100. The wash water supply portion 312 may be connected to the upper flow path.

The wash water inflow portion 311 and the wash water supply portion 312 may form flow paths that correspond to each other and may be linear. For example, the wash water inflow portion 311 and the wash water supply portion 312 may comprise a linear pipe or tube, and the central region thereof is connected to the upper flow path portion 313.

The second body portion 350 may be coupled to one side of the first body portion 310 so that when the pressure in the wash water inflow portion 311 and the wash water supply portion 312 equals or exceeds a set or predetermined pressure, the wash water is discharged to reduce the pressure. The second body portion 350 may have a tubular or cylindrical shape having a flow path connected to the upper flow path portion 313 and the regulated flow path portion 314 in the inner central region. The second body portion 350 may include an accommodating portion 351, a lower flow path portion 352 and an auxiliary drain 355.

The accommodating portion 351 may be coupled with the first body portion 310 and/or receive the lower portion of the first body portion 310. For example, the inner surface of the accommodating portion 351 may have a shape corresponding to the lower outside surface of the first body portion 310. A fixing unit 358 may be inside the accommodating portion 351. Two or more fixing units 358 may be spaced apart from each other at a set distance along the circumference of the lower flow path portion 352.

The fixing unit 358 may include an insertion path 353*a* and a rotation path 353*b*. The insertion path 353*a* may be a groove or opening extending downward along the inner surface of the upper end of the second body portion 350, and the rotation path 353*b* may be a groove or opening extending a set length along the circumference of the second body portion 350 at the lower end of the insertion path 353*a*. The first body portion 310 may couple with the second body portion 350 by rotating after aligning the fixing protrusion 317 on the outside surface of the lower portion with the insertion path 353*a*, and then inserting the fixing protrusion 317 by the set length in the direction of the second body portion 350. In addition, the outer surface of the first body portion 310 and the outer surface of the second body portion 350 may include auxiliary fastening portions 318 and 357 aligned with and/or facing each other. One of the auxiliary fastening portions 318 and 357 may comprise a hole and the other may comprise a groove or hole with a set depth. The auxiliary fastening portion 318 may be fastened to the auxiliary fastening portion 357 by a fastening means such as a bolt, screw or the like.

The lower flow path portion 352 may be between the auxiliary drain 355 and the accommodating portion 351 so that the regulated flow path portion 314 and the auxiliary drain 355 are connected to each other. The cross-sectional area of the lower flow path portion 352 may be less than the regulated flow path portion 314 and greater than the auxiliary drain. The lower end of the first body portion 310 and the bottom surface of the inside of the accommodating portion 351 are spaced apart from each other by a set distance, and a gasket 320 may be between the bottom surface of the inside of the accommodating portion 351 and the lower end of the first body portion 310.

A guide 358 may be in the lower flow path portion 352. The guide 358 may comprise a rib or tongue that may be longitudinally oriented the vertical direction. A plurality of guides 358 may be a set distance apart along the circumference of the lower flow path portion 352. An upper end portion of the guide 358 may protrude and/or incline toward the inside of the lower flow path portion 352 from the upper side to the lower side.

An elevating member or valve 330 may be inside the first body portion 310 and the second body portion 350. The elevating member 330 may include a plate in the regulated flow path portion 314 that is larger (i.e., has a larger diameter) than the cross-sectional area of the upper flow path portion 313 and the lower flow path portion 352, but smaller than the cross-sectional area of the regulated flow path portion 314. An elastic member or spring 340 may be between the elevating member 330 and a lowermost inner surface of the second body portion 350. The upper end of the elastic member 340 may contact the elevating member 330, and the lower end of the elastic member 340 may contact a step formed between the lower flow path portion 352 and the auxiliary drain 355. The upper surface of the elevating member 330 may have an upper guide 331 extending in the direction of the upper flow path portion 313 and having a cross-sectional area or width smaller than the cross-sectional area of the upper flow path portion 313. The upper end portion of the upper guide 331 may be inclined so as to protrude upward in the downward direction. The elevating member 330 may move up and down in alignment with the upper flow path portion 313 by the upper guide 331 in the upper flow path portion 313.

In addition, the lower surface of the elevating member 330 may have a lower guide 332 extending in the direction of the lower flow path portion 352 and inside the elastic member 340. The cross-sectional area of the lower guide 332 may be smaller than the cross-sectional area of the lower flow path portion 352 and the diameter of the elastic member 340. The lower end of the lower guide 332 may be tapered or pointed (e.g., inclined toward the center as it goes downward). The lower guide 332 enables the elevating member 330 to move up and down in alignment with the lower flow path portion 352.

So that the gas may be effectively dissolved or mixed into the wash water in the dissolving unit 100, the wash water supplied to the dissolving unit 100 should have a set pressure or be within a predetermined range of pressures. If the pressure of the wash water supplied to the dissolving unit 100 is lower than the set pressure or minimum predetermined pressure, the gas will not effectively dissolve in or mix with the wash water. On the other hand, if the pressure of the wash water supplied to the dissolving unit 100 becomes too high or exceeds the maximum predetermined pressure, the water supply line may be damaged by the pressure of the wash water.

In order to prevent wash water from entering the micro-bubble generator with excessively high pressure, one may include a decompression packing at the outlet of the water supply valve unit 32. However, in this case, since the total water pressure entering the micro-bubble generator is relatively low, the micro-bubble generator may not operate when the water pressure is low.

According to the present disclosure, the pressure regulating unit 300 may be set such that the pressure in or applied to the water supply line (e.g., by the elastic member 340, which may have a predetermined elastic modulus) may be controlled to a set pressure or a pressure within a set range. When the pressure of the water supply line L1 equals or exceeds the set pressure, a force applied to or on the elevating member 330 by wash water in the upper flow path portion 313 may be greater than the force applied to the elevating member 330 by the elastic member 340, and thus, the elevating member 330 may move downward. Thus, the upper flow path portion 313 may be connected to the regulated flow path portion 314 so that the wash water of the water supply line L1 may discharge through the auxiliary drain 355, and the water supply line L1 may be prevented from being broken by excessive pressure. In this case, the distance that the elevating member 330 moves downwardly may be limited by the distance that the elastic member 340 is elastically deformable. In addition, the oblique shape of the upper end of the guide 358 prevents impedance of the elastic deformation of the elastic member 340 when the elastic member 340 moves downwardly.

The wash water discharged to the auxiliary drain 355 may flow into the inner basket 22 (or the outer basket 20). As an example, the auxiliary drain 355 may be above the inner basket 22 and/or the flow direction of the wash water may be directed toward the inner basket 22 (e.g., using a separate nozzle). Further, an adjustment line or tube (not shown) may be connected to the auxiliary drain 355, and the end of the adjustment line or tube may be positioned above the inner basket 22 so that the discharged wash water may flow into the inner basket 22. Depending on the embodiment, the auxiliary drain 355 may be connected to the leaked water discharge line L2 or the nozzle portion 240.

When the pressure of the water supply line L1 returns to the set pressure or to a pressure within the set range, the elastic member 340 may lift or force the elevating member 330 back to a default (e.g., closed) position that shields the upper flow path portion 313 and the regulated flow path portion 314.

Hereinafter, the operation and effect of the washing machine 1 and the micro-bubble generator BG, and a method of supplying wash water including micro-bubbles according to one or more embodiments of the disclosure, will be described.

First, the wash water may be supplied from an external water supply source via a water supply valve unit 32. Next, the gas may be dissolved or mixed in the wash water in the dissolving unit 100.

Herein, in order to dissolve or mix the gas in the wash water in the dissolving unit 100, the wash water may be supplied through the water supply line connection unit 151 of the cap 150 in the horizontal direction from the water supply valve unit 32 above the dissolving unit 100, and the horizontal flow direction of the wash water in the cap 150 may change to the vertical direction by the water supply direction switching portion 152 of the cap 150. The wash water may be relatively uniformly discharged by the water supply direction switching portion 152, and may fill the partition wall 120 and then overflow. The wash water overflowing from the partition wall 120 may enter the space between the partition wall 120 and the dissolving body 110 to allow the gas to dissolve or mix in the wash water.

By this process, the wash water in which the gas is dissolved or mixed is supplied from the dissolving unit 100 to the nozzle unit 200, and the nozzle unit 200 may form micro-bubbles by splitting the bubbles in the wash water.

The bubbles formed by dissolving or mixing the gas in the wash water in the dissolving unit 100 may enter the inlet 224*a*, where the flow rate may increase. Subsequently, the bubbles in the water with the increased flow rate pass through the outlet 224*b* of the decomposition unit 224. Since the flow slows down and the pressure increases while passing through the decomposition unit 224, the bubbles may be split into micro-bubbles. A portion of the micro-bubbles discharged from the decomposition unit 224 may be indirectly injected into the first mixing space 242 by contacting the first blocking surface 243 in the nozzle portion 240, and the amount of micro-bubble generation may increase during the collisions between the bubbles. The wash water discharged from the first mixing space 242 may pass through the second mixing space 244, may be prevented again from being directly injected (e.g., to the inner basket 22) by the second blocking surface 245, and may then be discharged through a discharging portion 246, during which the amount of micro-bubble generation may increase. In the course of the above processes, the discharged micro-bubbles may flow into the inner basket 22 by the aid of the inner surface of the discharging portion 246 and/or the second blocking surface 245. Thus, the nozzle unit 200 may discharge the wash water containing the micro-bubbles into the inner basket 22, where the laundry is accommodated.

During the operation of the micro-bubble generating unit, some wash water may remain inside the micro-bubble generating unit. In order to discharge the wash water remaining in the micro-bubble generating unit (hereafter, residual wash water), a hole in the micro-bubble generating unit may discharge the residual wash water, and hole may be connected to the main drain valve or a separate valve structure on a path through which the residual wash water is discharged. However, when the micro-bubble generating unit is constructed as described above, there is a problem that it is difficult to generate the micro-bubbles by supplying the wash water to the micro-bubble generating unit before discharging the residual wash water from the micro-bubble generating unit. Accordingly, there is a problem that it is difficult to use the micro-bubble generating unit in a plurality of washing processes. Thus, if the valve discharges the residual wash water in one washing process, the user may mistakenly think that the wash water in the outer basket has been drained due to the sound generated during the residual wash water discharge process.

In contrast, according to one embodiment of the present disclosure, the washing machine may be configured such that the wash water remaining in the dissolving unit 100 may be minimized, and the residual wash water may be drained without operating a separate valve. Accordingly, the micro-bubbles may be supplied by operating the dissolving unit 100 a plurality of times without concern for the user even in a single washing process. In addition, the nozzle unit 200 and the dissolving unit 100 may have a compact integral-type structure. Thus, the micro-bubble generator may be installed above the inner basket 22 without restriction of the installation space, and micro-bubble-containing water may be supplied to the laundry immediately after the micro-bubbles are generated.

Figure 11:
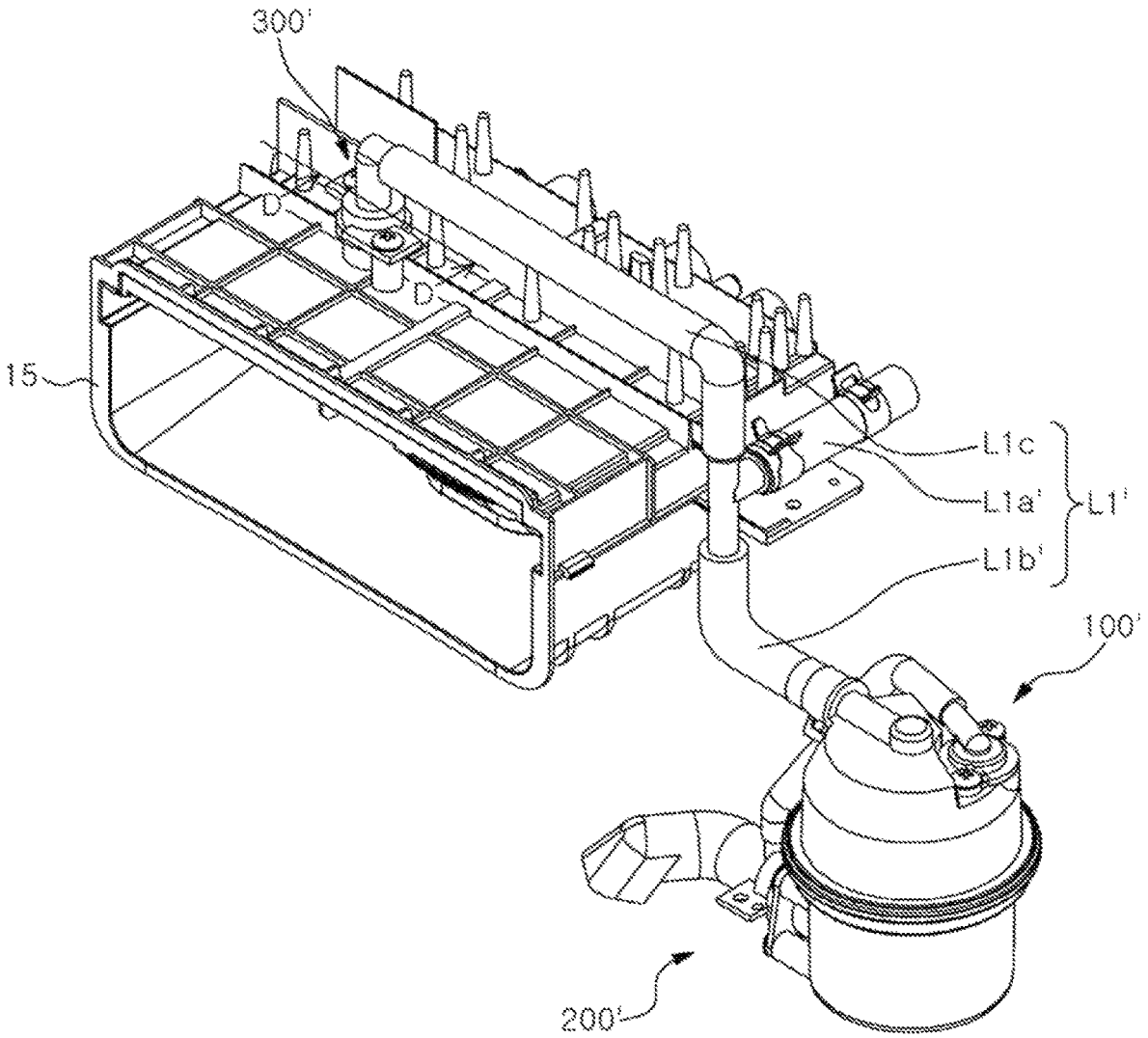
FIG. 11 is a view showing a configuration of an exemplary micro-bubble generator according to another embodiment.
Figure 12:
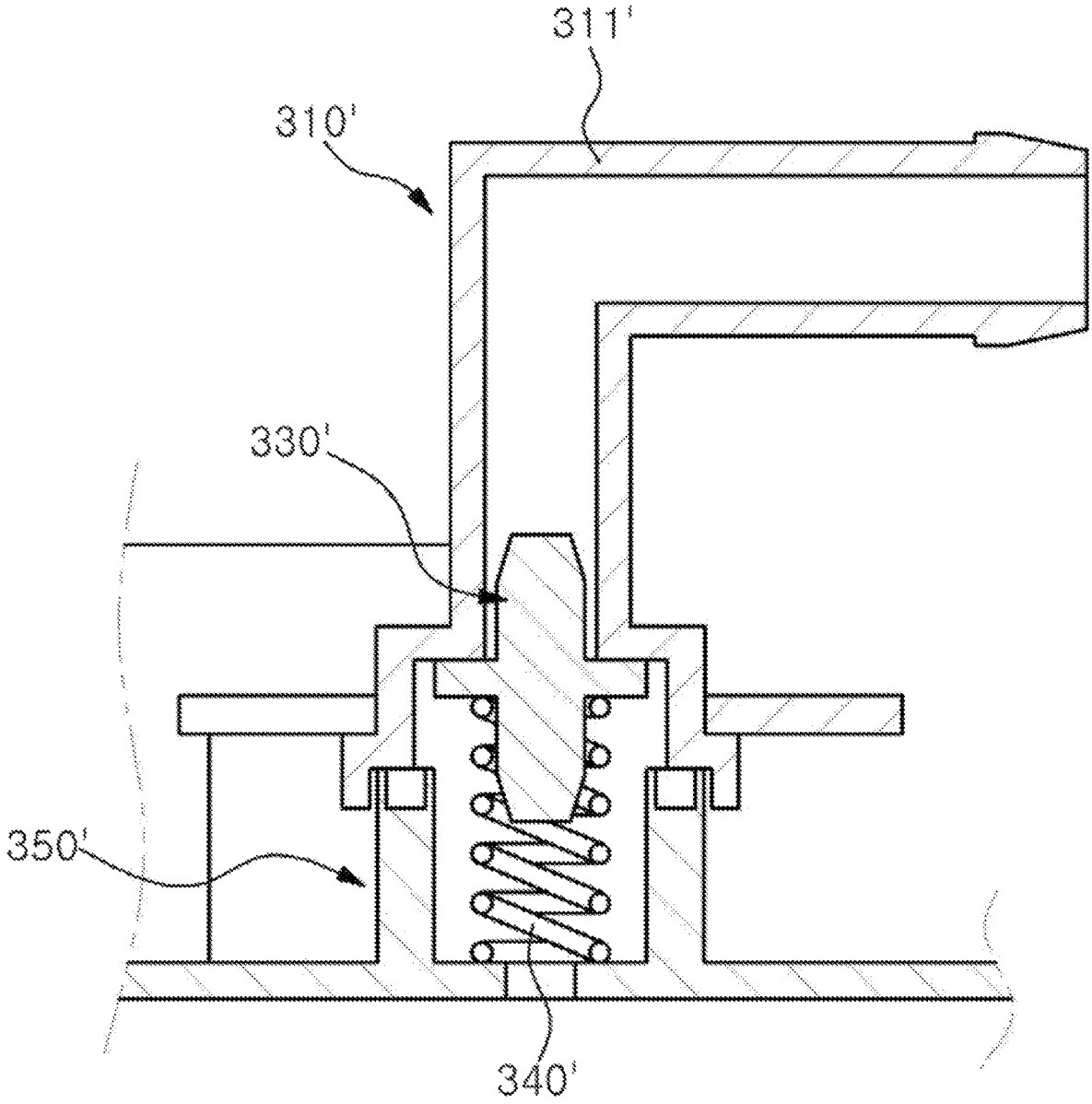
FIG. 12 is a cross-sectional view of a pressure regulating unit taken along the line D-D in FIG. 11.

FIG. 11 is a view showing a configuration of a micro-bubble generator according to another embodiment, and FIG. 12 is a cross-sectional view of a pressure regulating unit taken along a line D-D in FIG. 11.

Referring to FIGS. 11 and 12, the micro-bubble generator may include a dissolving unit 100' and a nozzle unit 200'.

The construction and operation of the dissolving unit 100' and the nozzle unit 200' may be the same as or similar to the dissolving unit 100 and the nozzle unit 200 of FIGS. 3 to 7, and thus the repeated explanations are omitted.

The dissolving unit 100' may be connected to the water supply valve unit 32 through the water supply line L1', similarly to the micro-bubble generator of FIG. 2, so that the micro-bubbles may be generated by receiving the wash water and supplied to the laundry.

The water supply line L1' may include a front water supply line L1*a*', a rear water supply line L1*b*' and a branch line L1*c*'. One side or end of the front water supply line L1*a*' may be connected to the water supply valve unit 32. The rear water supply line L1*b*' may connect the dissolving unit 100' to the other side or end of the front water supply line L1*a*'. The branch line L1*c*' may be branched at the point where the front water supply line L1*a*' and the rear water supply line L1*b*' are connected, and the branch line L1*c*' may be connected to the detergent container accommodating portion 15.

A pressure regulating unit 300' may be at the point where the branch line L1*c*' and the detergent container accommodating portion 15 are connected.

The pressure regulating unit 300' may include a first body portion 310' and a second body portion 350'. A wash water inflow portion 311' connected to the branch line L1*c*' may be at one side of the first body portion 310'.

An elevating member or valve 330' and an elastic member or spring 340' may be in the space inside the first body portion 310' and the second body portion 350' so that when the pressure of the water supply line L1' exceeds the set pressure, the pressure regulating unit 300' allows the wash water to be discharged to the inside of the detergent container accommodating portion 15. Thus, it is possible to allow the pressure inside the water supply line L1' to maintain the set pressure or a pressure within a set range. Some of the components of the pressure regulating unit 300' may be integral with the detergent container accommodating portion 15, or be fixedly inserted in a hole in the detergent container accommodating portion 15, so that the pressure regulating unit 300' may be on one side of the accommodating portion 15. FIGS. 11 and 12 illustrate that, as an example, the second body portion 350' may be integral with a detergent container accommodating portion 15. The configuration and operation of the pressure regulating unit 300' is the same as or similar to that of the pressure regulating unit 300 of FIGS. 8 to 10, except that the wash water supply portion 312 in the pressure regulating unit 300 of FIGS. 8 to 10 is omitted, so repeated descriptions are omitted.

Figure 13:
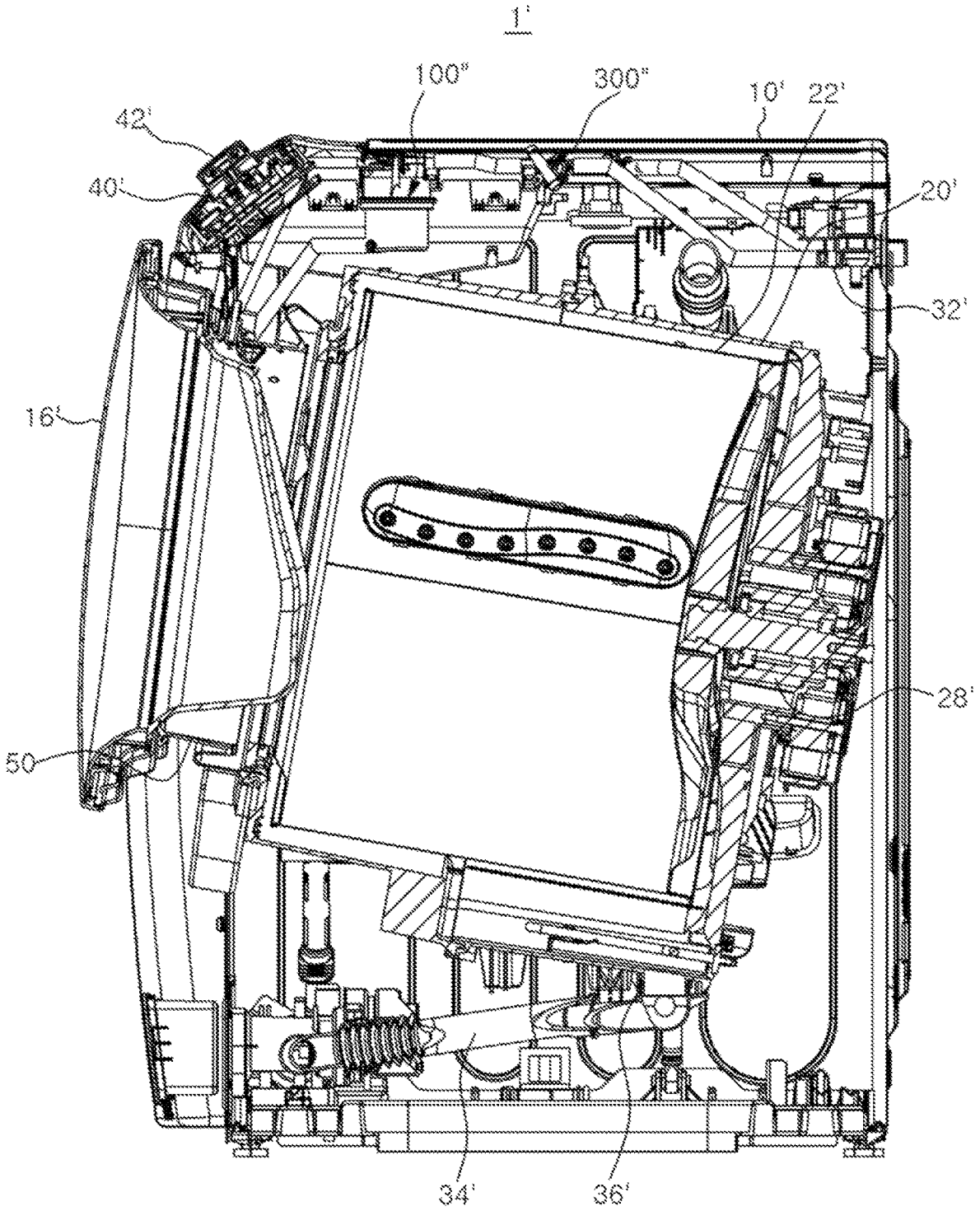
FIG. 13 is a view showing a schematic configuration of an exemplary washing machine according to another embodiment.

FIG. 13 is a view showing a schematic configuration of a washing machine according to another embodiment.

Referring to FIG. 13, according to another embodiment of the present disclosure, a washing machine 1' may include a cabinet 10', a tub 20', and a drum 22' as a front loading-type washing machine.

The cabinet 10' provides the overall appearance of the washing machine 1' and may function as an external case. The cabinet 10' may protect various components of the washing machine 1' that may have, among other things, a heat radiation structure. The space in the cabinet 10' may include the components of the washing machine 1'.

A door 16' may be on one side of the cabinet 10'. The door 16' may shield (e.g., close) or open one side of the cabinet 10' for loading or unloading the laundry. When the user loads the laundry to be washed into the washing machine 1', or unloads the completely washed laundry from the washing machine 1', the user may open the door 16' to load or unload the laundry into or from the washing machine 1'. In addition, when the washing process is performed, the user may cover the opening into the washing machine 1' with the door 16'.

A tub 20' may be inside the cabinet 10'. The tub 20' may have a cylindrical structure capable of receiving the wash water and may be tilted relative to a vertical plane so that an open end of the tub 20' may face the door 16' in the front of the cabinet 10'.

The tub 20' may be supplied with detergent from the detergent container and may receive the wash water from the water supply valve unit 32'.

A drum 22' may be inside the tub 20'. The drum 22' may be rotated in the tub 20' by the motor 28'. A washing space 31 for washing the laundry may be inside the drum 22'. The laundry may be washed by the wash water and detergent supplied in the tub 20' and may move in conjunction with the drum 22' during the rotation of the drum 22'.

The main drain valve 36' may be at the bottom of the tub 20' and may control drainage of the wash water in the tub 20'. Specifically, the main drain valve 36' may communicate with the lower portion of the tub 20', and a main drain hose 34' may be connected to the main drain valve 36'.

According to the present embodiment, the tub 20' and the drum 22' may correspond to the outer basket 20 and the inner basket 22 of the washing machine of FIG. 1, respectively, in terms of accommodating the wash water and the laundry. Therefore, the tub 20' and the drum 22' according to the present embodiment may be referred to as an outer basket 20' and an inner basket 22', respectively, in order to correspond to the name.

A door gasket 50 may be between the cabinet 10' and the tub 20' in the region of the door 16'. The door gasket 50 may have a generally cylindrical shape so that one open side may face the cabinet 10' where the door 16' is located and the other open side may face the tub 20'.

The door gasket 50 may comprise a soft material such as rubber, silicone, and the like, and may have a stretchable or pliable structure. Opposing sides or surfaces of the door gasket 50 may be in contact with the cabinet 10' and the tub 20' to prevent the wash water from leaking between the cabinet 10' and the tub 20'.

In addition, the washing machine 1' may include a control unit 40' and an operation unit 42'. The operation unit 42' may be on the outside upper portion of the cabinet 10'.

Figure 14:
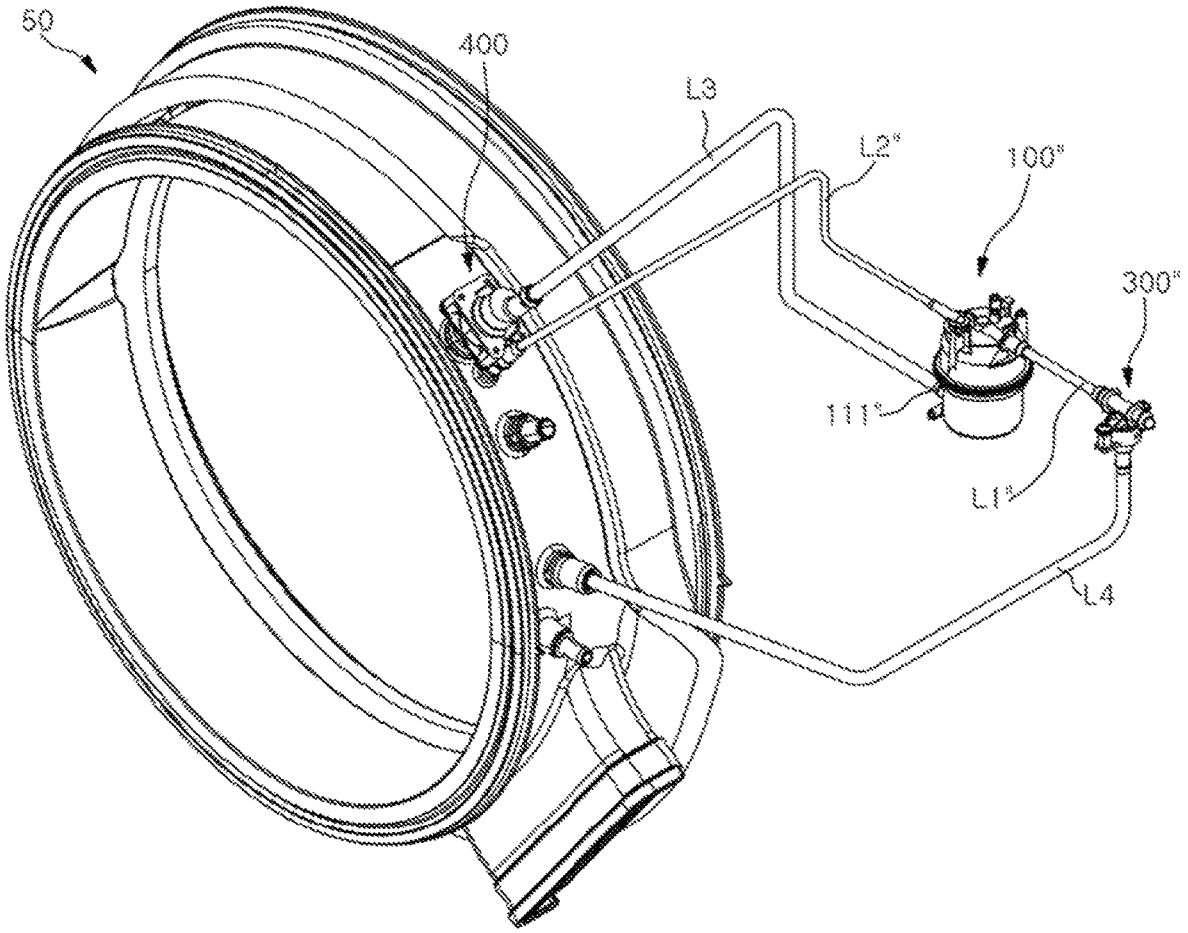
FIG. 14 is a view showing a configuration of an exemplary micro-bubble generator connected to a door gasket of the washing machine of FIG. 13.
Figure 15:
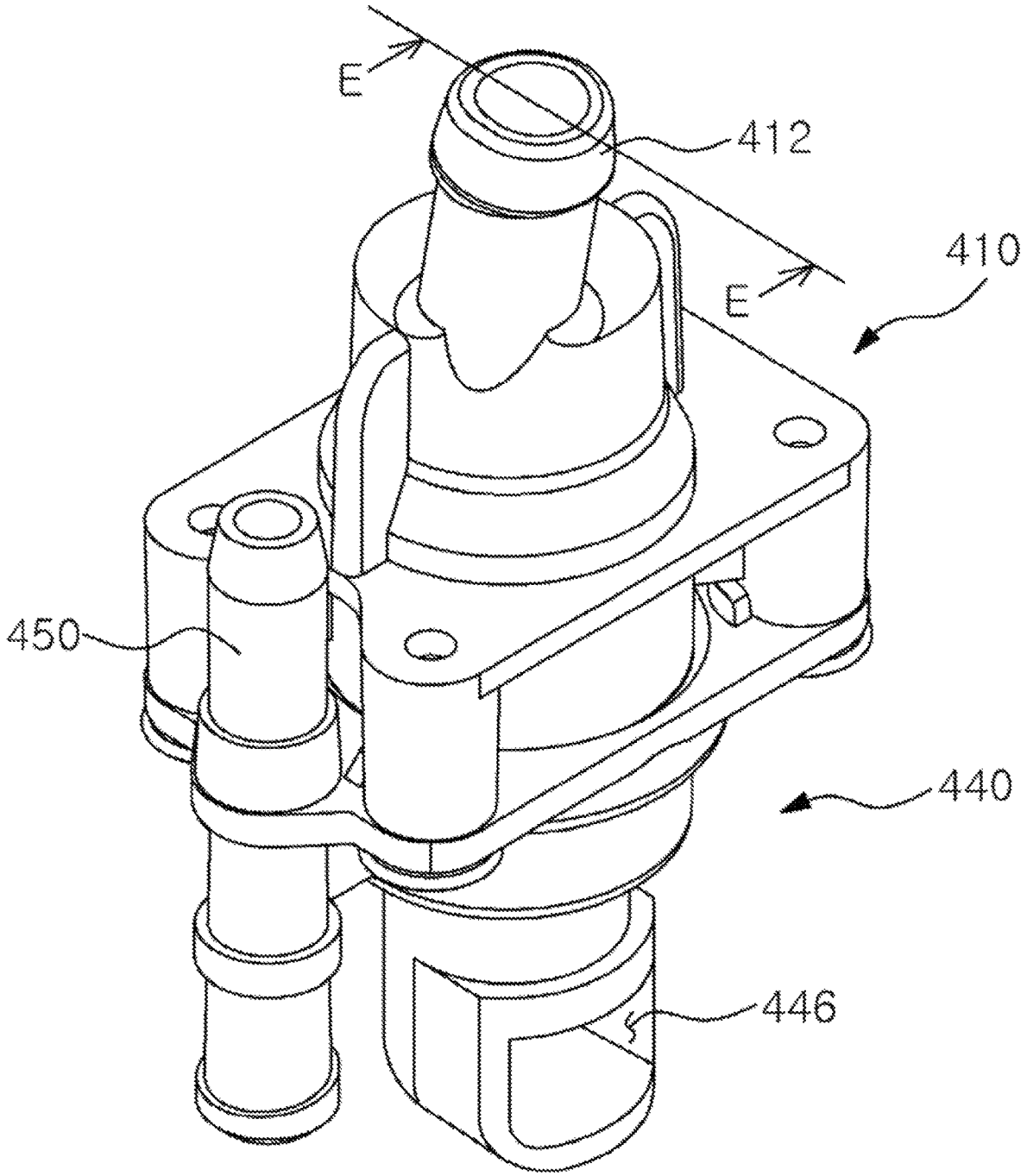
FIG. 15 is a perspective view of an exemplary nozzle unit.
Figure 16:
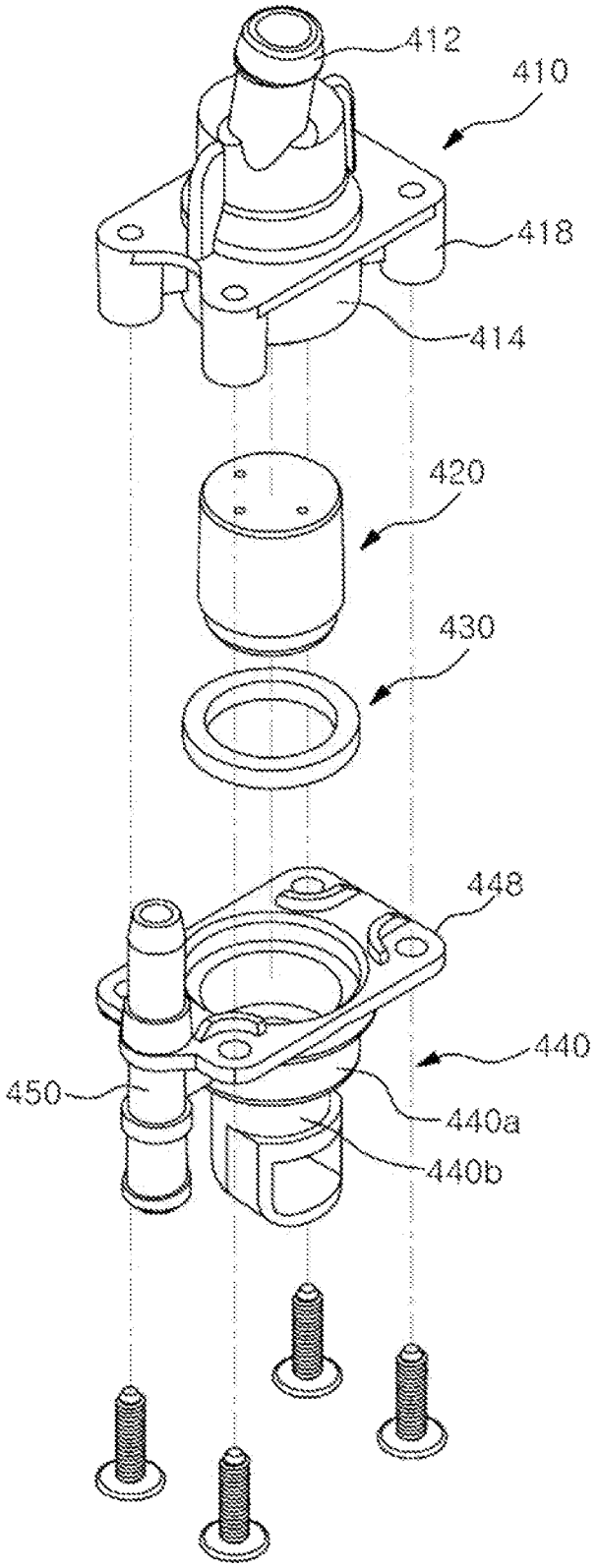
FIG. 16 is an exploded perspective view of the nozzle unit of FIG. 14.
Figure 17:
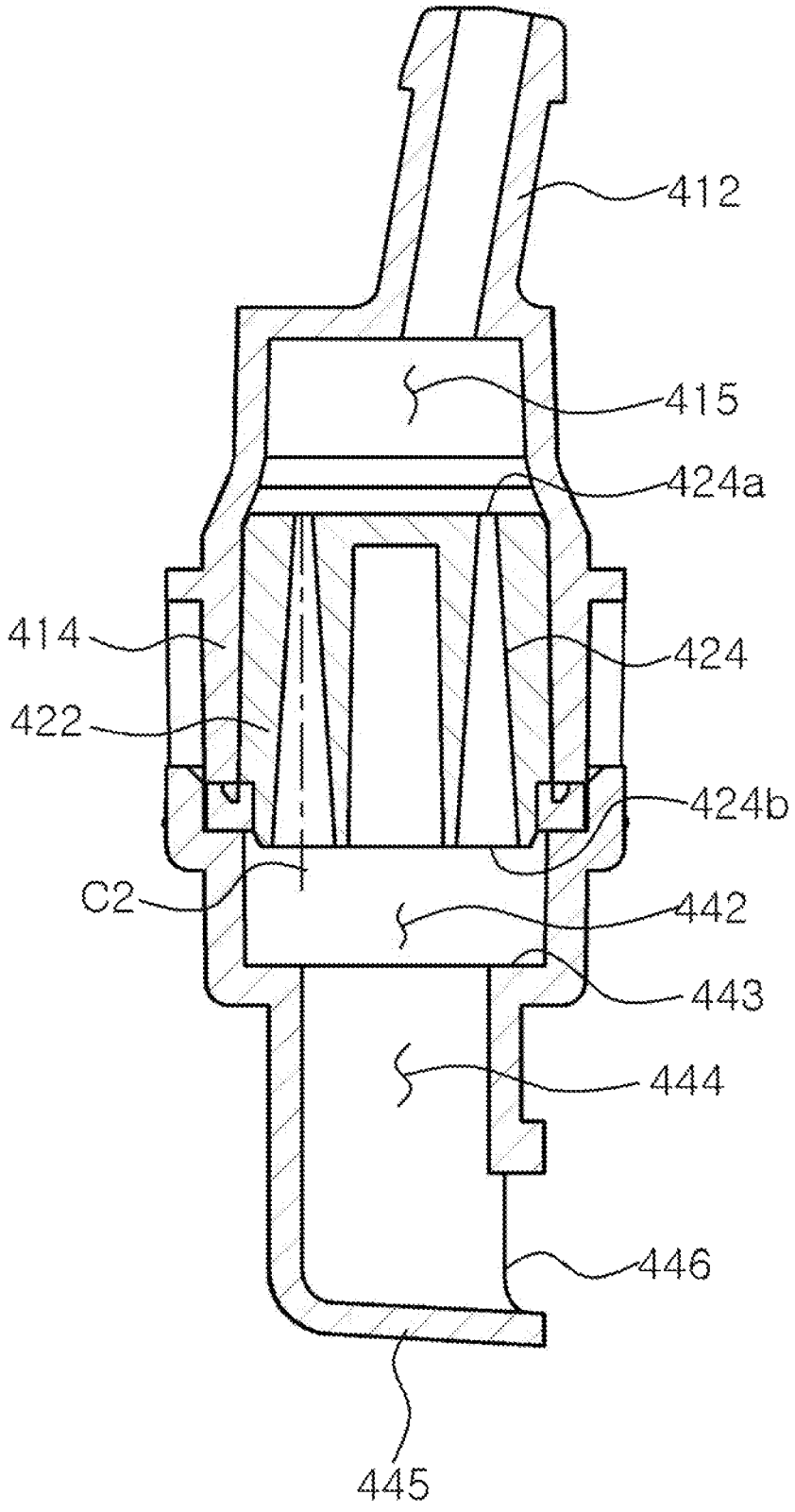
FIG. 17 is a sectional view taken along the line E-E in FIG. 15.

FIG. 14 is a view showing a configuration of an exemplary micro-bubble generator connected to a door gasket, FIG. 15 is a perspective view of an exemplary nozzle unit, FIG. 16 is an exploded perspective view of the nozzle unit of FIG. 15, and FIG. 17 is a sectional view of the nozzle unit of FIG. 15 taken along the line E-E.

According to another embodiment of this disclosure, the micro-bubble generator may include a dissolving unit 100" and a nozzle unit 400.

The micro-bubble generator may be in the upper inside portion of the washing machine 1'.

The dissolving unit 100" may be connected to the water supply valve unit 32' through a water supply line L1". The dissolving unit 100" may be connected to the nozzle unit 400 through a supply line L3, and the wash water discharged from the dissolving unit 100" may flow into the nozzle unit 400. The water leaking from the dissolving unit 100" may be discharged through the leaked water discharge line L2" and the nozzle unit 400 into the tub 20'. The nozzle unit 400 may be connected to the drain 111" of the dissolving unit 100" through the supply line L3, and the flow path inside the drain 111" may be the same as or similar to that of FIGS. 2 to 7, except that the flow path may be smaller than that inside the drain 111 of the dissolving unit 100 of FIGS. 2 to 7, so repeated descriptions are omitted.

Further, a pressure regulating unit 300" may be on or in the water supply line L1". The pressure regulating unit 300" also includes a path through which the wash water flows into the tub 20', without passing through the dissolving unit 100", through an adjustment line L4. When the water supply line L1" reaches a set or predetermined pressure, the wash water is discharged from the pressure regulating unit 300" towards the adjustment line L4. The adjustment line L4 may be connected to the door gasket 50. The construction and operation of the pressure regulating unit 300" may be the same as or similar to the pressure regulating unit 300 of FIGS. 2 to 8, and thus the repeated descriptions are omitted.

The nozzle unit 400 may generate the micro-bubbles by receiving the wash water in which gas is dissolved or mixed from the dissolving unit 100. Specifically, the nozzle unit 400 may split or increase the bubbles in the water from the dissolving unit 100" and then discharge the micro-bubble-containing water to the inner basket 22'. The nozzle unit 400 may be fixed to and/or inserted into a hole in the door gasket 50. The hole to which the nozzle unit 400 is fixed or inserted may be in the upper portion and/or region of the door gasket 50.

The nozzle unit 400 may include a body portion 410 connected to the dissolving unit 100", a micro-bubble generator 420 configured to generate micro-bubbles, a gasket 430 and a nozzle portion 440 for discharging the wash water containing micro-bubbles to the inner basket 22'.

The body portion 410 may include a dissolving unit connection unit 412, and the dissolving unit connection unit 412 may be connected to the supply line L3 to receive the water in which the gas is dissolved or mixed from the dissolving unit 100".

The body portion 410 may be supplied with the wash water in which the gas is dissolved or mixed, and the wash water may be pressurized inside the body portion 410. This body portion 410 may include the dissolving unit connection unit 412, a micro-bubble generator accommodating portion 414, a pressurizing space 415 and nozzle portion connection units 418.

The dissolving unit connection unit 412 may be connected to the supply line L3 to supply the wash water in which the gas is dissolved or mixed from the dissolving unit 100" into the nozzle unit 400.

The micro-bubble generator accommodating portion 414 may be connected to the pressurizing space 415 to receive the micro-bubble generator 420. The micro-bubble generator accommodating portion 414 may communicate with the dissolving unit connection unit 412 and may extend or protrude toward the nozzle portion 440. The micro-bubble generator accommodating portion 414 may have a diameter that is larger than the dissolving unit connection unit 412. Specifically, the micro-bubble generator accommodating portion 414 may correspond to or have a size and shape accommodating the size, shape, and cross-sectional area of the micro-bubble generator 420 so that the micro-bubble generator 420 may be inserted therein. However, the micro-bubble generator accommodating portion 414 may be longer than the micro-bubble generator 420, and after the micro-bubble generator 420 is inserted, the pressurizing space 415 may be formed between the dissolving unit connection unit 412 and the micro-bubble generator 420.

The micro-bubble generator accommodating portion 414 may include a step a predetermined distance from one end of the micro-bubble generator accommodating portion 414 (e.g., connected to the dissolving unit connection unit 412), which may form the pressurizing space 415 by separating the micro-bubble generator 420 from the one end connected to the dissolving unit connection unit 412 by the predetermined distance. By engaging the micro-bubble generator 420 with the step, when the micro-bubble generator 420 is inserted into the micro-bubble generator accommodating portion 414, it may be spaced a predetermined distance apart from the dissolving unit connection unit 412. The pressurizing space 415 may be the space between the end of the dissolving unit connection unit 412 and the micro-bubble generator 420.

The dissolving unit connection unit 412 may be connected to one end of the pressurizing space 415, and the wash water containing the bubbles may be introduced into the pressurizing space 415. The pressurizing space 415 may be supplied with the wash water in which the gas is dissolved or mixed from the dissolving unit 100", and the wash water may be pressurized within the pressurizing space 415. Specifically, the wash water in which the gas is dissolved or mixed may pass through the supply line L3 with a narrow flow path, enter the pressurizing space 415 having a cross-sectional area wider than the supply line L3, and be pressurized before passing through the micro-bubble generator 420 having a cross-sectional area smaller than the cross-sectional area of the pressurizing space 415. As the pressure increases, the amount of bubble generation in the wash water may increase. Therefore, water containing bubbles may be supplied to the decomposition unit 424 by increasing the pressure of the wash water in which the gas is dissolved or mixed in the pressurizing space 415.

The nozzle portion connection units 418 may be at the circumference of the micro-bubble generator accommodating portion 414 and may be connected to the body connection unit 448 of the nozzle portion 440 to fix the body portion 410 to the nozzle portion 440 or vice versa. The nozzle portion connection units 418 may fasten the body portion 410 and the nozzle portion 440, and may extend from opposite sides of the micro-bubble generator accommodating portion 414. Each nozzle portion connection unit 418 may include a hole into or through which a fastening member may be inserted. A total of four nozzle portion connection units 418 may form a square or rectangle around the outer circumferential surface of the micro-bubble generator accommodating portion 414.

The micro-bubble generator 420 may be inserted into the micro-bubble generator accommodating portion 414 on one side of the pressurizing space 415. The micro-bubble generator 420 may include a housing 422 accommodatable in the body portion 410, and a plurality of decomposition units 424 at predetermined intervals inside the housing 422 along a circumference of the housing 422. In an embodiment of the present disclosure, three decomposition units 424 are in the housing 422. However, the present disclosure is not limited to three decomposition units, and may include one or more decomposition units 424.

The decomposition unit 424 may be or comprise a cone or a tube whose diameter widens along the direction of the fluid flow from the pressurizing space 415, indicating the flow path within the housing 422. A plurality of decomposition units 424 may be in the housing 422, and the decomposition unit(s) 424 may communicate with the pressurizing space 415. The wash water entering the decomposition unit 424 from the pressurizing space 415 may pass through the decomposition unit 424 to generate micro-bubbles. In this case, the opening at the side where the wash water is introduced into the decomposition unit 424 may be referred to as the inlet 424*a* of the decomposition unit 424, and the opening at the side where the wash water is discharged from the decomposition unit 424 may be referred to as the outlet 424*b*. The inlet 424*a* and the outlet 424*b* are centered on one another (e.g., may have a common linear axis), and the inlet 424*a* may have a smaller cross-sectional area than the outlet 424*b*. Thus, the decomposition unit 424 may extend from the inlet 424*a* to the outlet 424*b* and have a tapered cross-sectional shape along the flow path therein.

The wash water in which the gas is dissolved or mixed may contain relatively large bubbles, and the wash water may be introduced from the pressurizing space into the inlet 424*a* of the decomposition unit 424 and discharged from the outlet 424*b*. The diameter of the inlet 424*a* communicating with the pressurizing space 415 may be much less than the diameter of the pressurizing space 615, and at the same time, the wash water may flow into and/or through the inlet 424*a* from the pressurizing space 415 at an increased rate. The wash water may gradually expand as it passes through the decomposition unit 424, and the flow rate of the wash water may decrease and the pressure may increase at the same time. Thus, the bubbles contained in the wash water may be split to generate micro-bubbles, or new bubbles may be generated in the wash water.

The gasket 430 may be at the circumference of the outlet side of the decomposition unit 424 of the micro-bubble generator 420. The gasket 430 may surround the micro-bubble generator 420 inside the nozzle portion 440 and press the end of the body portion 410 when the micro-bubble generator 420 is inserted into the nozzle portion 440. Thus, the gasket 430 is pressurized and fixed by the body portion 410 and the nozzle portion 440, thereby preventing leakage of water containing micro-bubbles from the nozzle unit 400. The gasket 430 may comprise an o-ring, but is not limited thereto.

The nozzle portion 440 may be coupled to the body portion 410 so that the micro-bubble generator 420 may be fixed inside the body portion 410 to discharge the micro-bubble-containing water to the inner basket 22. The first portion 440*a* may include a first mixing space 442, and the second portion 440*b* connected to the first portion 440*a* may discharge the wash water in which micro-bubbles are dissolved or mixed into the upper portion of the inner basket 22. The first portion 440*a* and the second portion 440*b* may include blocking portions 443 and 445 to prevent at least a portion of the wash water discharged from each decomposition unit 424 from being directly injected (e.g., into the inner basket 22), and micro-bubble mixing units 442 and 444 configured to mix micro-bubbles from the micro-bubble generating unit 424 with wash water having a slow flow after being discharged from the decomposition unit 424.

Specifically, the first part 440*a* may include a first mixing space 442 communicating with the decomposition unit 424 and having the same cross-sectional area as the cross-sectional area of the housing 422, and a first blocking surface 443 that alters the flow of the wash water in the first mixing space 442. In addition, the second portion 440*b* may include a second mixing space 444 connected to the first mixing space 442 and having a smaller cross-sectional area than the first mixing space 442, and a second blocking surface 445 that alters the flow of the wash water in the second mixing space 444.

As such, the first mixing space 442 and the second mixing space 444 may increase the amount of micro-bubble generation by preventing direct spraying or injection, while maximizing the flow path.

The first mixing space 442 may be a cylinder or tube having a shape corresponding to the cross-sectional shape of the micro-bubble generator 420, and may have a diameter corresponding (e.g., equal) to the diameter of the micro-bubble generator 420. The first mixing space 442 may be a space in which wash water having a slow flow after being discharged from the decomposition unit 424 is mixed with micro-bubble-containing water discharged from the decomposition unit 424. Specifically, after passing through the decomposition unit 424, the wash water with the slow flow may be discharged into the first mixing space 442, and some of the wash water with the slow flow may stay or reside in the first mixing space 442. In this case, the wash water continuously injected from the decomposition unit 424 and the wash water staying in the first mixing space 442 may collide and mix, the bubbles in the wash water may be further split, and the micro-bubbles may be more uniformly distributed in the wash water.

The second mixing space 444 allows the wash water discharged from the first mixing space 442 to stay for a certain time, and the wash water rapidly discharged from the first mixing space 442 may collided with the wash water staying or residing in the second mixing space 444, so that additional micro-bubbles may be generated.

Herein, the second mixing space 444 may have a smaller diameter than the first mixing space 442, and the first mixing space 442 and the second mixing space 444 may have a step. In this case, the step leading from the first mixing space 442 to the second mixing space 444 may be the first blocking surface 443. In this case, the step may have a height corresponding to the center line C connecting the center of the inlet 424*a* of the decomposition unit 424 and the center of the outlet 424*b*.

The first blocking surface 443 may extend from the side of the first mixing space 442 and have a shape or surface that is parallel to the surface of the outlet 424*b* of the decomposition unit 424 or that is inclined or protruding toward the decomposition unit 424. In one example, the first blocking surface 443 may be at a predetermined distance from the outlet 424*b* of the decomposition unit 424 or the outlet of the nozzle portion 440, and may form one side or edge of the first mixing space 442. In this case, the end or inner edge of the first blocking surface 443 may be at a height corresponding to 90% to 110% of the distance from the side surface of the first mixing space 442 to the extension of the center line C of the decomposition unit 424. In this embodiment, the end of the first blocking surface 443 is at a height corresponding to the extension of the center line C of the decomposition unit 424, as an example. By forming the first blocking surface 443, the wash water may be prevented from being directly injected from the decomposition unit 424 and then discharged immediately, and the configuration of the nozzle portion 440 may be simplified while maximizing the size of the flow path through which the wash water is supplied.

The wash water may be slowed by running from the decomposition unit (424) with a narrow flow path to the first mixing space 442 where the flow path is widened. In this case, the first blocking surface 443 may prevent the flow of the slow wash water from being discharged by being directly injected from the decomposition unit 424 to the first mixing space 442 and the second mixing space 444. Thus, the flow may be slowed in the first mixing space 442 by the first blocking surface 443 and may be injected in the temporarily stayed water and the decomposition unit 424 so that the wash water may be collided with the first blocking surface 443 and the wash water again injected to the first mixing space to generate micro-bubbles. The first blocking surface 443 may be formed at an angle such that it is not formed obliquely to the running direction to prevent the wash water discharged from the decomposition unit 424 from being injected directly. By preventing the direct injection, it is possible to prevent the micro-bubble generated in the decomposition unit 424 from spreading evenly in the wash water or to prevent the micro-bubble being discharged immediately without a sufficient time to be dissolved or mixed, and additional micro-bubbles may be generated in the first mixing space 442.

In summary, according to an embodiment of the present disclosure, in the nozzle unit 400, the bubbles introduced from the dissolving unit 100" may pass through the outlet 424*b* of the decomposition unit 424, and the flow of the water in the decomposition unit 424 may slow and the pressure of the water in the decomposition unit 424 may increase at the same time. Thus, the bubbles may be split into micro-bubbles, and additional bubbles may be created. The micro-bubble-containing water with the slow flow passing through the decomposition unit 424 may be discharged to the first mixing space 442, and some of the micro-bubble-containing water may be discharged to the second mixing space 444, optionally slowly from the first mixing space 442. Some of the micro-bubble-containing water may collide with the first blocking space 443. Thus, it is possible to prevent direct injection (e.g., of the micro-bubble-containing water to the second mixing space 444 and/or the inner basket 22). The micro-bubble-containing water impinging on the first blocking surface 443 may be not directly injected into the second mixing space 444, but may be injected into the first mixing space 442 so that a collision between bubbles in the water may occur in the first mixing space 442. Such collisions may split the bubbles into micro-bubbles, and the amount of bubble generation may increase. Thus, since the micro-bubbles may strike the first blocking surface 443 and may be not fed directly into the second mixing space 444 by direct injection, but additional micro-bubbles may be generated by the first blocking surface 443, thereby increasing the amount of micro-bubbles.

The micro-bubbles generated in the first mixing space 442 may be discharged to the second mixing space 444. The second mixing space 444 may serve as a guide to guide the micro-bubble-containing water to a discharge position where the micro-bubble-containing water is discharged into the inner basket 22. A second blocking surface 445 may be at a portion of the second mixing space 444, guiding the water to the discharge position. The micro-bubble-containing water discharged from the first mixing space 442 may collide with the second blocking surface 445, and direct injection (e.g., of the micro-bubble-containing water into the inner basket 22) may be prevented once more. The bubbles discharged from the first mixing space 442 may collide with the second blocking surface 445 and may be split into micro-bubbles to increase the amount of micro-bubbles generated. In addition, since the second blocking surface 445 may be at the discharge position, the micro-bubbles discharged after colliding with the second blocking surface 445 may be supplied directly into the inner basket 22. In addition, the nozzle portion 440 may further include a discharge portion 446 and a body connection unit 448.

The wash water in which the micro-bubbles are dissolved or mixed through the discharge part 446 may be discharged into the washing space. The discharge portion 446 may face the inner basket 22'. The inner surface of the discharge portion 446 may be or comprise a second blocking surface 445. In addition, the discharge portion 446 may have a predetermined angle relative to the second mixing space 444 (or a central axis thereof) toward the inner basket 22 so as to be directed toward the inner basket 22. The second blocking surface 445 may have an inclination at a predetermined angle in the direction of the inner basket 22 so as to correspond thereto. Since the discharge part 446 may be inclined toward the inner basket 22, it is possible to prevent scattering of the discharged micro-bubbles.

The body connection unit 448 may include a surface extending from one end of the nozzle portion 440 orthogonal to the vertical direction of the flow path in the nozzle unit 400 and include holes at positions corresponding to the nozzle connection units 418 of the body portion 410. A fastening member may be inserted into the hole. Thus, the body connection unit 448 may be brought into contact with the nozzle connection units 418 of the body portion 410 and a fastening member such as a bolt or screw may be inserted through the body connection unit 448 and into the nozzle connection units 418 to fasten the body portion 410 to the nozzle portion 440.

A leaked water inflow portion 450 may be at one side of the discharge portion 446 to provide a path through which the wash water leaking from the gas supply unit 170 is discharged to the inner basket. The leaked water inflow portion 450 may comprise a pipe or tube with a set length and may be at one side of the nozzle unit 400. As an example, the leaked water inflow portion 450 may be in the nozzle portion 440, through the body connection unit 448. In addition, the leaked water inflow portion 450 may be on one side of the body portion 410 and/or the nozzle portion 440.

According to an embodiment of the present disclosure, in summary of the flow principle of the wash water in the nozzle unit 400, the wash water flowing through the dissolving unit connection unit 412 may enter into the pressurizing space 415 and be pressurized while staying or residing therein for a predetermined time, Thereafter, when the wash water from the pressurizing space 415 passes through the decomposition unit 424, the bubbles in the wash water may be split into micro-bubbles, and/or additional micro-bubbles may be generated. At least part of the wash water discharged from the decomposition unit 424 to the first mixing space 442 may collide with or be blocked by the first blocking surface 443 in the first mixing space 442, and may stay for a certain time in the first mixing space 442, whereby additional micro-bubbles may be generated and/or the micro-bubbles may be more uniformly distributed in the wash water. In addition, the micro-bubble-containing water passing through the first mixing space 442 may strike the second blocking surface 445 in the second mixing space 444 to prevent the direct injection of the micro-bubble-containing water (e.g., into the inner basket 22) and increase micro-bubble generation. Therefore, it is possible to increase washing power and rinsing power by increasing micro-bubble production.

Figure 18:
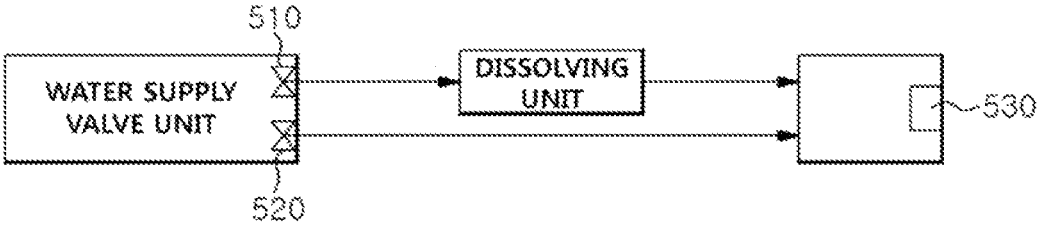
FIG. 18 is a block diagram showing a path to which wash water is supplied.

FIG. 18 is a block diagram showing a path to which wash water is supplied.

Referring to FIG. 18, two or more flow paths for supplying the wash water from the water supply valve unit 32, 32' to the outer baskets 20, 20' and the inner basket 22, 22' may be provided. In this case, one of the flow paths supplying the wash water may be a path through which the wash water containing micro-bubbles is supplied via the dissolving unit 100, 100', and the other of the flow paths may be a path that does not pass through the dissolving unit 100, 100' and through which wash water not containing micro-bubbles passes. The water supply valve unit 32, 32' may be configured to include a first water supply valve 510 configured to turn on and/or off the supply of the wash water into the flow path via the dissolving unit 100, 100' and a second water supply valve 520 configured to turn on and/or off the supply of the wash water into the flow path that does not pass through the dissolving unit 100, 100'. Also, a water level sensor 530 may be in the outer basket 20, 20' or the inner basket 22, 22' where the wash water is received. As an example, the water level sensor 530 may detect the amount of wash water (e.g., in the outer basket 20, 20' or the inner basket 22, 22') by changes in the frequency of vibrations occurring in the outer basket 20, 20' or the inner basket 22, 22', depending on the amount of wash water in the outer basket 20, 20' or the inner basket 22, 22'.

Figure 19:
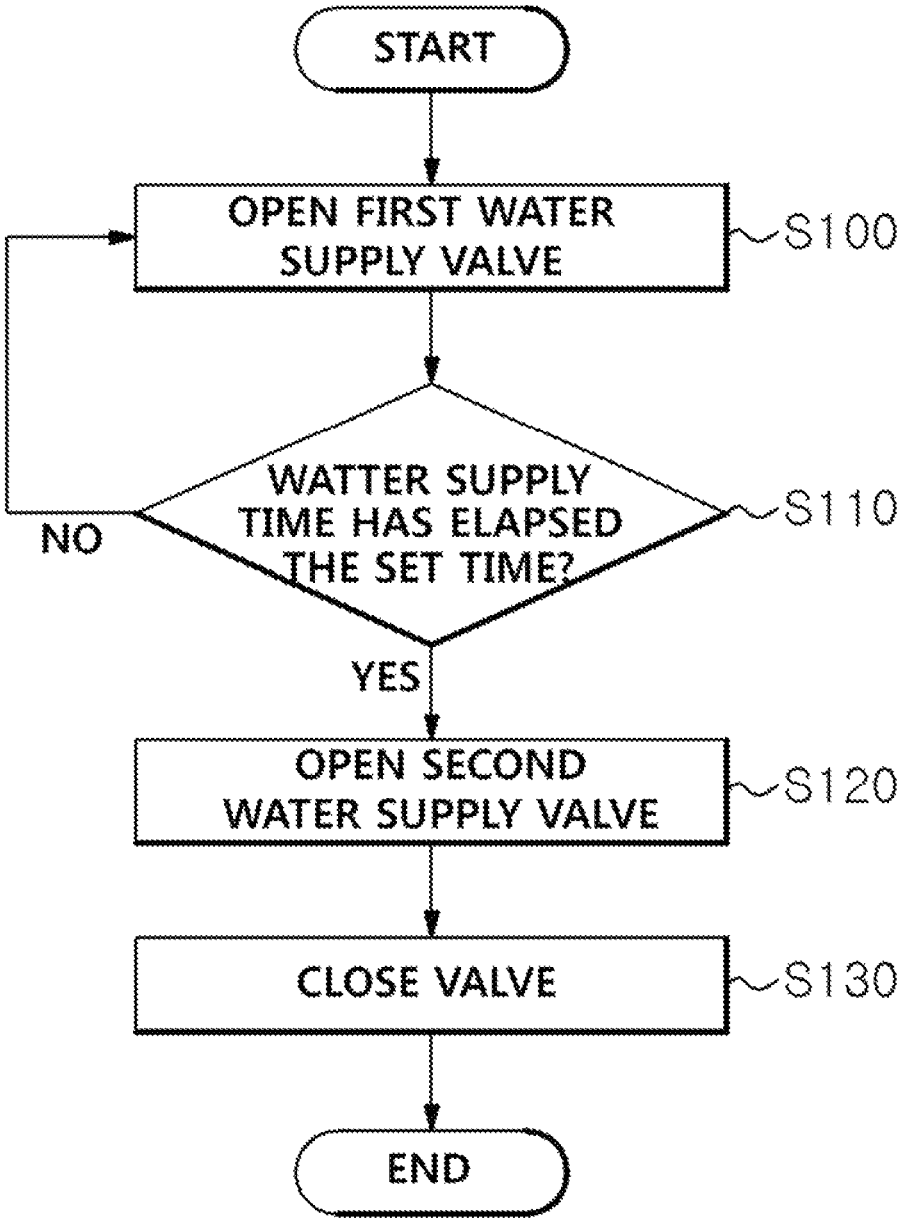
FIG. 19 is a flowchart showing an exemplary process of supplying wash water in a washing machine.

FIG. 19 is a flowchart showing an exemplary process of supplying wash water.

Referring to FIG. 19, when a washing stage is performed and wash water containing micro-bubbles is to be supplied, the control unit 40 or 40' causes the first water supply valve 510 to be opened (S100). In this case, the control unit 40, 40' may be set to supply a set amount of wash water. Accordingly, the wash water is supplied to the dissolving unit 100, 100' to generate the wash water containing micro-bubbles.

The supply of wash water containing the micro-bubbles may continue for a set time by opening the first water supply valve 510 (S110).

When the set time has elapsed, the control unit 40, 40' causes the second water supply valve 520 to be opened while the first water supply valve 510 remains opened (S130). Accordingly, the wash water is supplied through two paths, and the amount of wash water supplied per unit time may be increased.

Thereafter, when the set amount of the supplied wash water is reached, the control unit 40, 40' closes the first water supply valve 510 and the second water supply valve 520 to stop the supply of wash water.

However, the stages S110 and S120 described above are performed only when the wash water supplied within the set time does not reach the set amount. That is, if the wash water is supplied in the set amount only by supplying the wash water containing the micro-bubbles before the set time has elapsed, the control unit 40, 40' closes the first water supply valve 510 to stop the supply of wash water.

In order to supply water containing micro-bubbles to the outer basket 20, 20' and the inner basket 22, 22' in the above stages, the control unit allows the wash water to be supplied to the dissolving unit 200, 200' at set time intervals. Accordingly, when the supply of wash water to the dissolving unit 200, 200' is stopped, gas fills the dissolving unit 200, 200', and then micro-bubbles may be generated by newly supplied wash water.

The dissolving unit 100, 100' according to the present disclosure may generate bubbles in the wash water using the water supply pressure of the wash water supplied through the water supply line L1, L1', without using a power device. Accordingly, the flow path passing through the dissolving unit 100, 100' is longer than the flow path that does not pass through the dissolving unit 100, 100'. Therefore, the set amount of wash water may not be supplied to the laundry even after a relatively long period of time passes.

according to the method of supplying the wash water according to one embodiment of the present disclosure, if the set amount of wash water is not supplied (e.g., to the outer and/or inner baskets) even after the set time has elapsed, the wash water is supplied through two paths. Therefore, the delay in the wash water supply is reduced while the washing water containing micro-bubbles is supplied to the laundry.

As described above, embodiments of the disclosure provide a washing machine and a micro-bubble generator therefor capable of increasing the amount of micro-bubbles and improving washing abilities and rinsing abilities.

Further, embodiments of the disclosure provide a washing machine and a micro-bubble generator therefor in which the micro-bubbles do not disappear and may be supplied into an inner basket of the washing machine, in which the washing process is performed.

As described above, while the present disclosure has been described in connection with a washing machine, a micro-bubble generator of the washing machine, and a method of supplying wash water having micro-bubbles in the washing machine, it is merely an example, and the present disclosure is not limited thereto. It should be understood that the present disclosure has the widest range in compliance with the basic idea disclosed in the disclosure. Although it is possible for those skilled in the art to combine and substitute the disclosed embodiments to embody other types that are not specifically disclosed in the disclosure, they do not depart from the scope of the present disclosure as well. In addition, it will be apparent to those skilled in the art that various modifications and changes may be made with respect to the disclosed embodiments based on the disclosure, and these changes and modifications also fall within the scope of the present disclosure.

What is claimed is:

1. A washing machine, comprising:

a cabinet;

an outer basket in the cabinet and configured to accommodate wash water an inner basket in the outer basket and configured to accommodate laundry;

a water supply valve unit in the cabinet and connected to an external water supply source to receive wash water; and a micro-bubble generator configured to receive the wash water from the water supply valve unit, generate micro-bubbles, and supply the micro-bubbles to a washing space, wherein the micro-bubble generator includes a dissolving unit configured to mix or dissolve gas into the wash water from the water supply valve unit, and the dissolving unit includes:

a water supply line connection connected indirectly to the water supply valve unit to introduce the wash water;

a supply hole providing a path in which gas is introduced into a dissolution space in the dissolving unit;

a dissolved water drain portion discharging the wash water in which gas is dissolved or mixed;

a partition wall in the dissolving unit, including a residual water discharge hole configured to drain the wash water remaining inside the dissolving unit, wherein the partition wall partitions the dissolution space into an inner dissolution space and an outer dissolution space, and the residual water discharge hole faces the outer dissolution space in a direction opposite from the dissolved water drain portion; and an inner bottom surface inside the partition wall, angled or inclined toward the residual water discharge hole, and having one or more residual water guide grooves crossing the inner bottom surface, wherein the one or more residual water guide grooves have a set length, one end configured to interface with the residual water discharge hole and another end extending to the partition wall opposite from the residual water discharge hole.

2. The washing machine according to claim 1, wherein the partition wall extends a set distance upward from the inner bottom surface of the dissolving unit.

3. The washing machine according to claim 2, wherein the dissolved water drain portion is on or in an outer circumferential surface of the dissolving unit.

4. The washing machine according to claim 2, wherein a bottom surface inside the dissolving unit outside the partition wall is angled or inclined in a direction toward the dissolved water drain portion from the residual water discharge hole.

5. The washing machine according to claim 1, wherein the micro-bubble generator further includes a nozzle unit attached to the dissolving unit and configured to form micro-bubbles in the wash water from the dissolved water drain portion and discharge the same.

6. The washing machine according to claim 5, wherein the nozzle unit includes:

a micro-bubble generator in the dissolved water drain portion and having a decomposition unit including a path through which the wash water flows; and a nozzle portion coupled to the dissolving unit so that the micro-bubble generator is fixed in the dissolved water drain portion, the nozzle portion being configured to discharge the wash water.

7. The washing machine according to claim 6, wherein the decomposition unit comprises a cone.

8. The washing machine according to claim 6, wherein the nozzle unit further includes a gasket in the nozzle unit at an end of the micro-bubble generator and against an end of the dissolved water drain portion.

9. The washing machine according to claim 1, wherein the dissolving unit is above the inner basket.

10. The washing machine according to claim 1, further comprising a control unit configured to control components of the washing machine, including the water supply valve unit to supply the wash water to a flow path passing through the dissolving unit until a set time has elapsed, and when a set amount of the wash water has not been supplied at the set time, to supply the wash water with the wash water in a flow path not passing through the dissolving unit.

* * * * *